US012622525B1

(12) United States Patent
Abdullah Abdo et al.

(10) Patent No.: US 12,622,525 B1
(45) Date of Patent: May 12, 2026

(54) CHAIR HAVING AN ADJUSTABLE SEAT AND BACK

(71) Applicant: KING SAUD UNIVERSITY, Riyadh (SA)

(72) Inventors: Basem Motea Abdullah Abdo, Riyadh (SA); Mohanad Basem Motea Abdullah Abdo, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 19/332,036

(22) Filed: Sep. 17, 2025

(51) Int. Cl.

| | |
|---|---|
| ***A47C 7/14*** | (2006.01) |
| ***A47C 7/46*** | (2006.01) |
| ***A47C 7/54*** | (2006.01) |
| ***A47C 7/70*** | (2006.01) |

(52) U.S. Cl.
CPC ..... *A47C 7/144* (2018.08); *A47C 7/462* (2013.01); *A47C 7/541* (2018.08); *A47C 7/543* (2013.01); *A47C 7/70* (2013.01)

(58) Field of Classification Search
CPC ..... A47C 7/144; A47C 7/541; A47C 7/543; A47C 7/70
See application file for complete search history.

(56) References Cited

U.S. PATENT DOCUMENTS

| | | | | |
|---|---|---|---|---|
| 151,411 | A * | 5/1874 | Marshall | B60N 2/3086 297/236 |
| 343,265 | A * | 6/1886 | Bean | A47C 17/207 297/110 |
| 371,091 | A * | 10/1887 | Miller | A47C 1/023 297/238 |
| 527,709 | A * | 10/1894 | Mchenry | B60N 2/3084 297/383 |
| 3,971,592 | A | 7/1976 | Farley | |
| 7,093,904 | B1 | 8/2006 | McMillen | |
| 8,646,844 | B2 | 2/2014 | Blind et al. | |
| 9,693,634 | B2 | 7/2017 | Smith | |
| 11,503,915 | B1 | 11/2022 | Chang | |
| 2024/0051665 | A1 | 2/2024 | Kodati | |

FOREIGN PATENT DOCUMENTS

| | | | |
|---|---|---|---|
| CN | 112535368 | A | 3/2021 |
| CN | 214179800 | U | 9/2021 |
| WO | 2005/023163 | A1 | 3/2005 |

* cited by examiner

*Primary Examiner* — David R Dunn
*Assistant Examiner* — Tania Abraham
(74) *Attorney, Agent, or Firm* — Nath, Goldberg & Meyer; Joshua B. Goldberg

(57) ABSTRACT

A chair includes a plurality of legs, a seat, at least one seat extension member movably connected to the seat, a back support connected to the seat via a frame, the back support having at least one cavity, at least one back support extension member movably received in the at least one cavity, an arm support, and a connector extending between a first seat extension member from among the at least one seat extension member and the arm support, the connector connecting the first seat extension with the arm support. A method of using the chair includes moving the at least one seat extension member away from the seat to widen an area of the chair used for sitting, and/or moving the at least one back support extension member away from the back support to widen an area of the chair used for supporting a user's back.

18 Claims, 22 Drawing Sheets

CHAIR HAVING AN ADJUSTABLE SEAT AND BACK

TECHNICAL FIELD

The present disclosure relates to a chair, and more particularly, to a chair having an adjustable seat and an adjustable back, and a method of using the same.

DISCUSSION OF THE RELATED ART

Adjustable chairs are well known. Chairs have been manufactured to be adjustable in height, to be reclinable, to have adjustable armrests, etc. However, the adjustable chairs in the market do not conform to the needs of certain users.

SUMMARY

The present disclosure relates to an adjustable chair and a method of using the same. The adjustable chair of the present subject matter is configured to offer adjustment to the seating area, and more particularly, to enable the seat to become wider to accommodate the needs of certain individuals who might not be properly served by a standard chair having a fixed width. For example, the chair of the present subject matter may include a pair of seat extension members (e.g., a pair of slabs of durable material) disposed under and selectively extendable from a primary seating area (or seat).

The primary seat may be fixedly attached to a frame and legs of the chair. One of the seat extension members, (e.g., a left-hand side seat extension member), may be slid (or moved) from under the seat, where it might be mostly hidden from sight and not be usable as a seating area, in a direction toward the left-hand side of a user (which corresponds to the left-hand side of the chair). That is, the left-hand seat extension member can be pulled out from under the seat to offer additional seating area to the left side of the primary seat.

The other one of the seat extension members, (e.g., a right-hand side seat extension member), may be slid (or moved) from under the seat, where it might be mostly hidden from sight and not be usable as a seating area, in a direction toward the right-hand side of a user. In other words, the right-hand seat extension member can be pulled out from under the seat to offer additional seating area to the right side of the primary seat.

The back support of the chair of the present subject matter may be fixedly attached to the frame, legs, and/or seat of the chair. The back support may include a first cavity extending into the back support from a left-hand side surface of the back support. A first back support extension member can be inserted in the first cavity. The first back support extension member can be pulled out of the first cavity to extend outwardly from the left-hand side surface of the back support by a certain distance. The extension (or protrusion) of the first back support member from the left-hand side of the fixed back support widens a surface area that can be used to support the back of a user to the left-hand side of the back support.

The back support may also, or instead, include a second cavity extending into the back support from a right-hand side surface of the back support. A second back support extension member can be inserted in the second cavity. The second back support extension member can be pulled out of the second cavity to extend outwardly from the right-hand side surface of the back support by a certain distance. The extension (or protrusion) of the second back support member from the right-hand side of the fixed back support widens the surface area that can be used to support the back of a user to the right-hand side of the back support.

The first and second back support members can be nested in their respective cavities in the back support when not needed.

The chair of the present subject matter may also include a side structure that can be used as a writing surface and/or as an armrest. The side structure can be attached to left-hand side seat extension member or to the right-hand side seat extension member via a connecting member. The connecting member (or connector, for brevity) can have an adjustable height or a fixed height. The side structure can be pivoted at the top of the connector.

BRIEF DESCRIPTION OF THE DRAWINGS

The above and other features of the present disclosure will become more apparent by describing in detail exemplary embodiments thereof in conjunction with the accompanying drawings, in which.

DETAILED DESCRIPTION OF THE EMBODIMENTS

Figure 1:
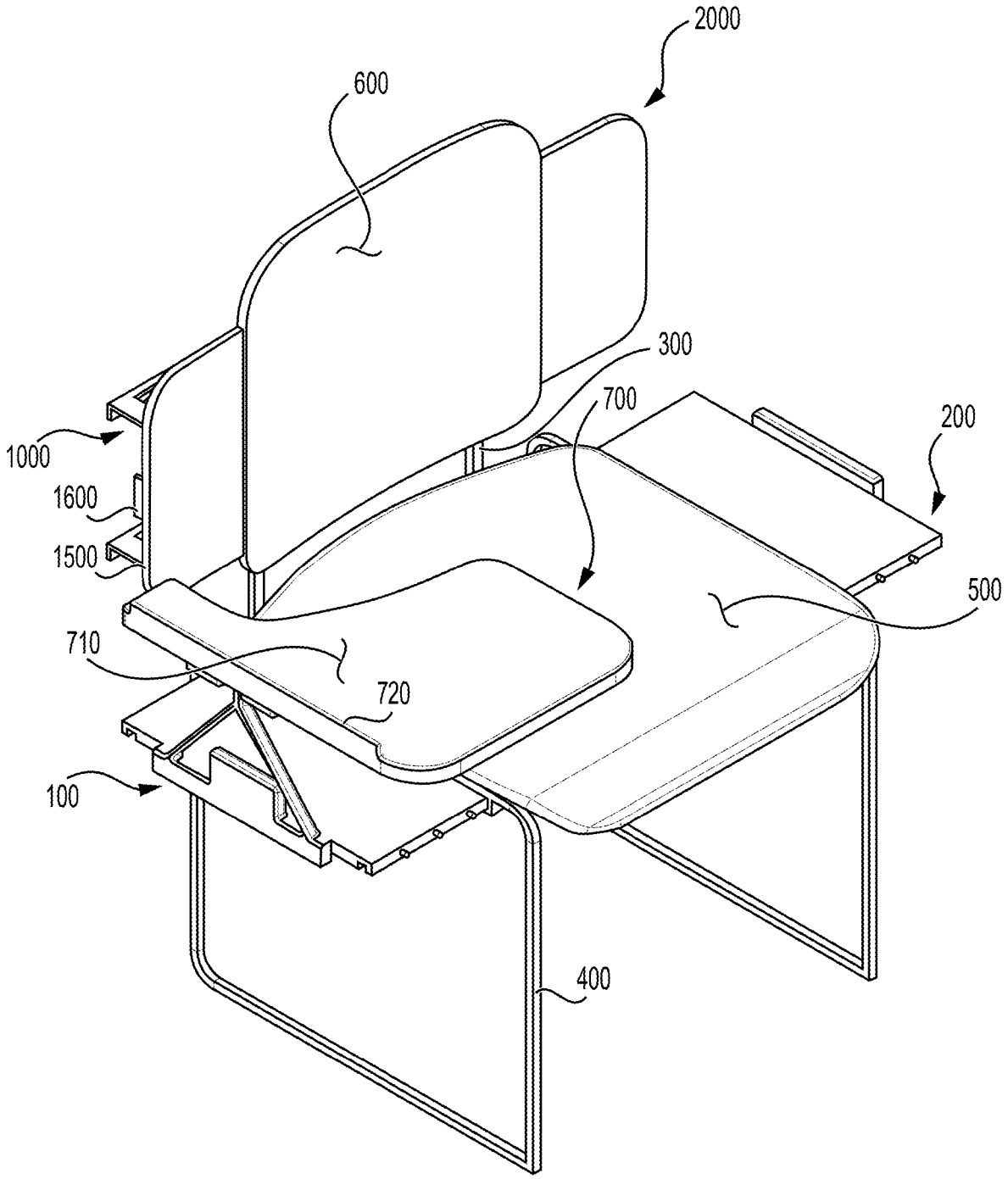
FIG. 1 is a first perspective view illustrating a chair in accordance with an embodiment of the present disclosure.

Exemplary embodiments of the present disclosure will be described more fully hereinafter with reference to the accompanying drawings. The present disclosure may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being disposed on another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

When an element is described as being connected to another element, intervening elements may be connected therebetween.

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" may include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a product or a method described herein can be combined in a variety of ways without departing from the spirit and scope of the present teachings, whether explicit or implicit herein.

The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

The term "optional" or "optionally" means that the subsequently described element, event or circumstance may or may not be present or occur, and that the description includes instances where said element, event or circumstance is present or occurs and instances in which it does not.

Unless defined otherwise, all technical and scientific terms used herein have the same meaning as commonly understood to one of ordinary skill in the art to which the presently described subject matter pertains.

Where a range of values is provided, for example, percentage ranges, ratio ranges, or the like, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

Referring to FIGS. 1-19, a chair of the present disclosure may include a frame 300, a plurality of legs 400 connected to the frame 300, a seat 500 connected to the frame 300 and to the plurality of legs 400, at least one seat extension member 100, 200 movably connected to the seat 500, a back support 600 connected to the frame 300 and to the seat 500, i.e., via the frame 300, at least one back support extension member 1000, 2000 movably connected to the back support 600, an arm support 700 and a connector 800 extending between a seat extension member from the at least one seat extension member 100, 200, the connector 800 connecting said seat extension member 100 or 200 with the arm support 700.

The at least one seat extension member 100, 200 is movably connected to the seat 500 such that the at least one seat extension member 100, 200 can be selectively moved along a width direction W1 (see FIG. 2) of the seat 500 by a variable distance. The width direction W1 of the seat 500 can define a path extending from a left-hand-side of the seat 500 toward a right-hand side of the seat 500, or vice-versa.

Figure 7:
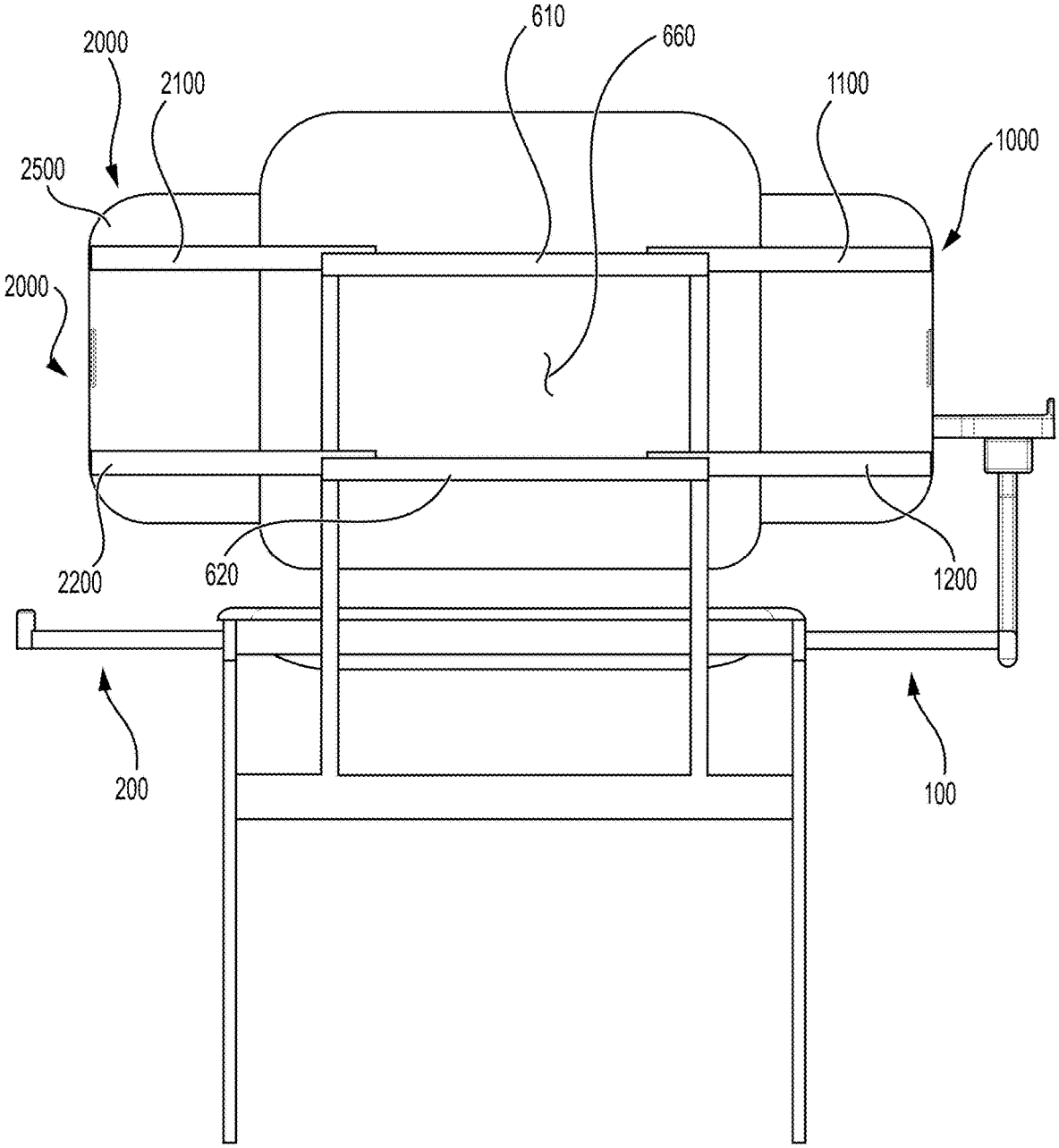
FIG. 7 is a rear side view illustrating the chair of FIG. 1.
Figure 8:
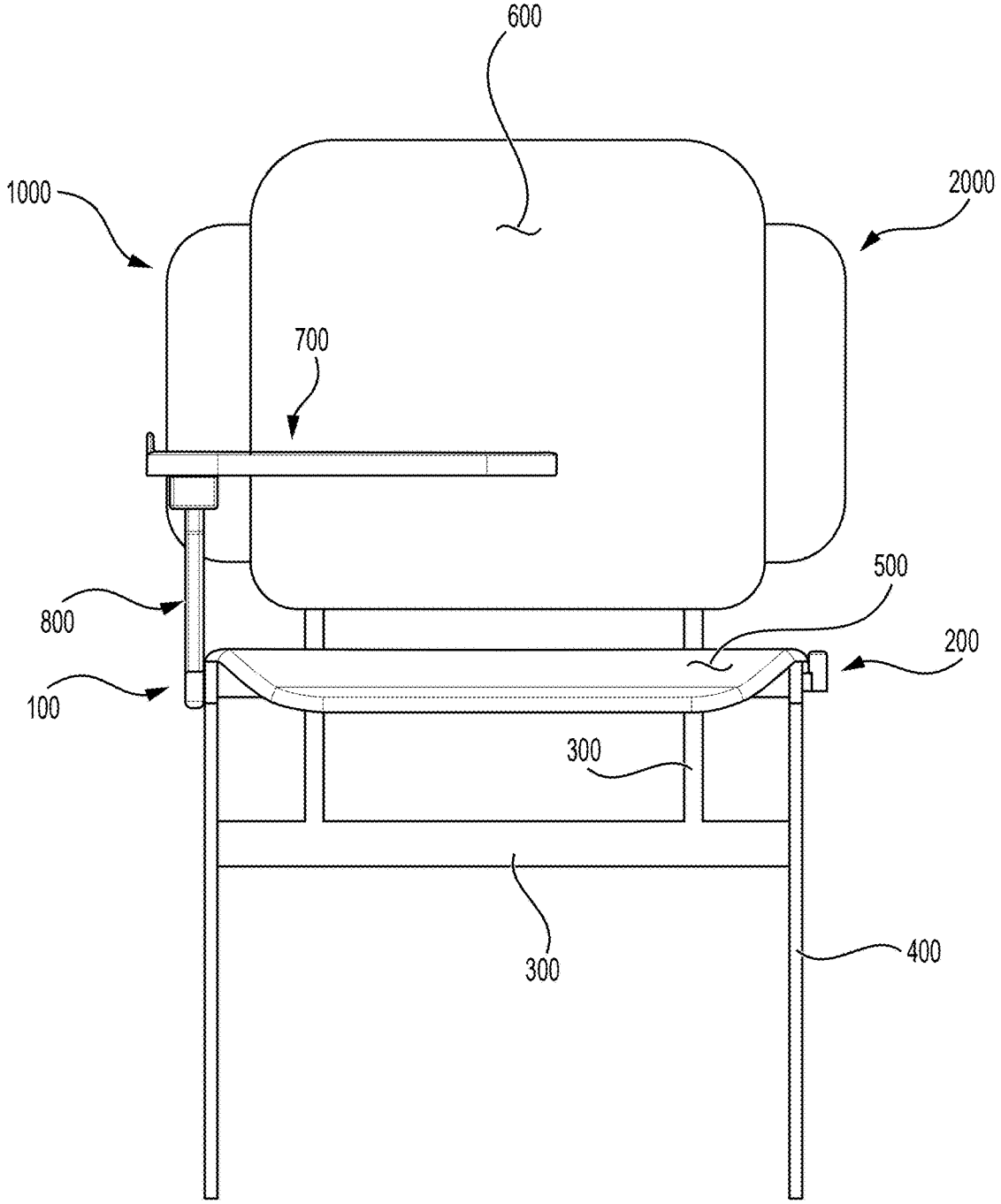
FIG. 8 is a second front side view illustrating the chair of FIG. 1.
Figure 9:
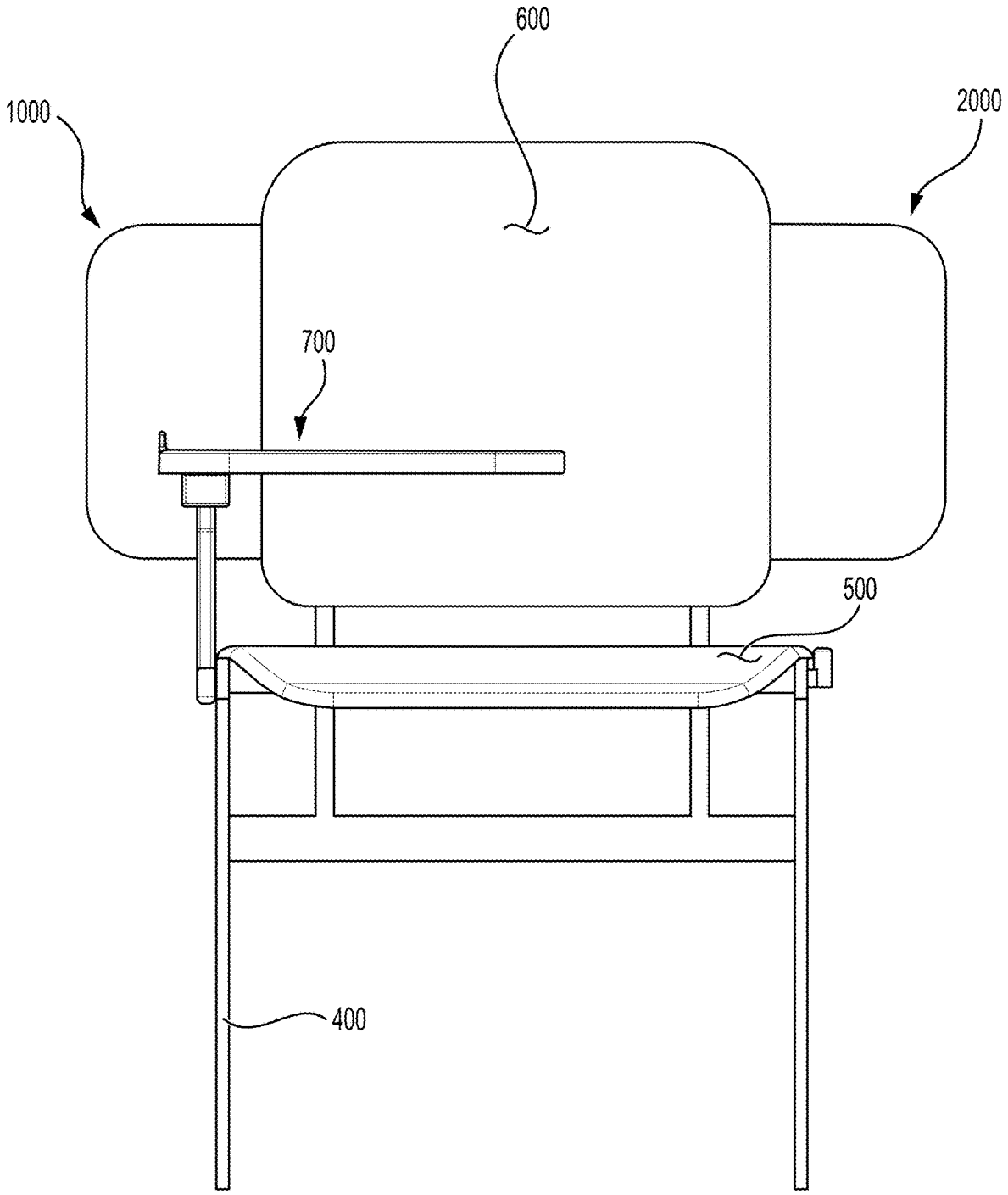
FIG. 9 is a third front side view illustrating the chair of FIG. 1.

A first seat extension member 100 of the at least one seat extension member 100, 200 is configured to be selectively moved along the width direction W1 of the seat 500 between a retracted state relative to the seat 500, as illustrated in FIG. 8, and an extended state relative to the seat 500, as shown in FIGS. 1-2, 5 and 7. As illustrated in FIGS. 1-2, 5 and 7-8, the first seat extension 100 overlaps the seat 500 by a greater amount in the retracted state than in the extended state. In other words, the first seat extension 100 may extend under the seat 500 by a greater amount in the retracted state thereof than in the extended state thereof.

The first seat extension member 100 may be referred to as a right-hand side seat extension member since it can be pulled away from a right-hand side of the seat 500 (or extend to the right of the seat 500) to provide additional seating and/or storage area to the right-hand side of the seat 500.

Figure 12:
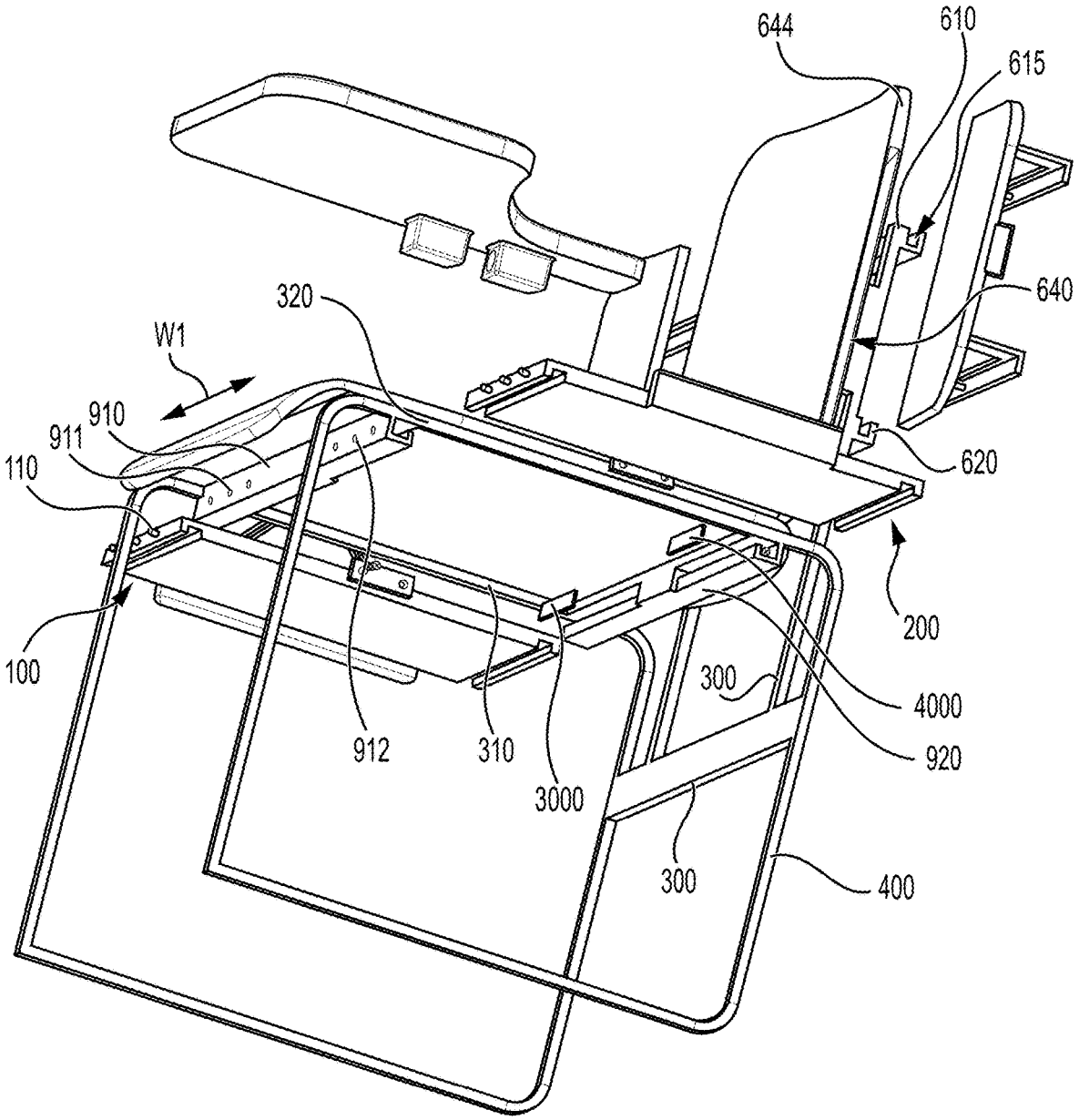
FIG. 12 is a second exploded perspective view illustrating the chair of FIG. 1.

Referring to FIG. 12, the chair of the subject matter may further include a first rail 910 and a second rail 920 spaced apart from the first rail 910, the first and second rails 910, 920 extending lengthwise in the width direction W1 of the seat 500. The first and second rails 910, 920 may extend in parallel to one another. The first and second rails 910, 920 connect the first seat extension member 100 to the seat 500 in a way that enables the first seat extension member 100 to be selectively moved along the first and second rails 910, 920 and to support weight thereon (e.g., the weight of a sitting person, the weight of books, etc.). For example, the first seat extension member 100 can be moved (e.g., slid) along a portion of a length of the first and second rails 910, 920.

The first and second rails 910, 920 can be connected to an underside of the seat 500, opposite to a top side surface of the seat 500 that is intended to accommodate a user thereon.

Figure 13:
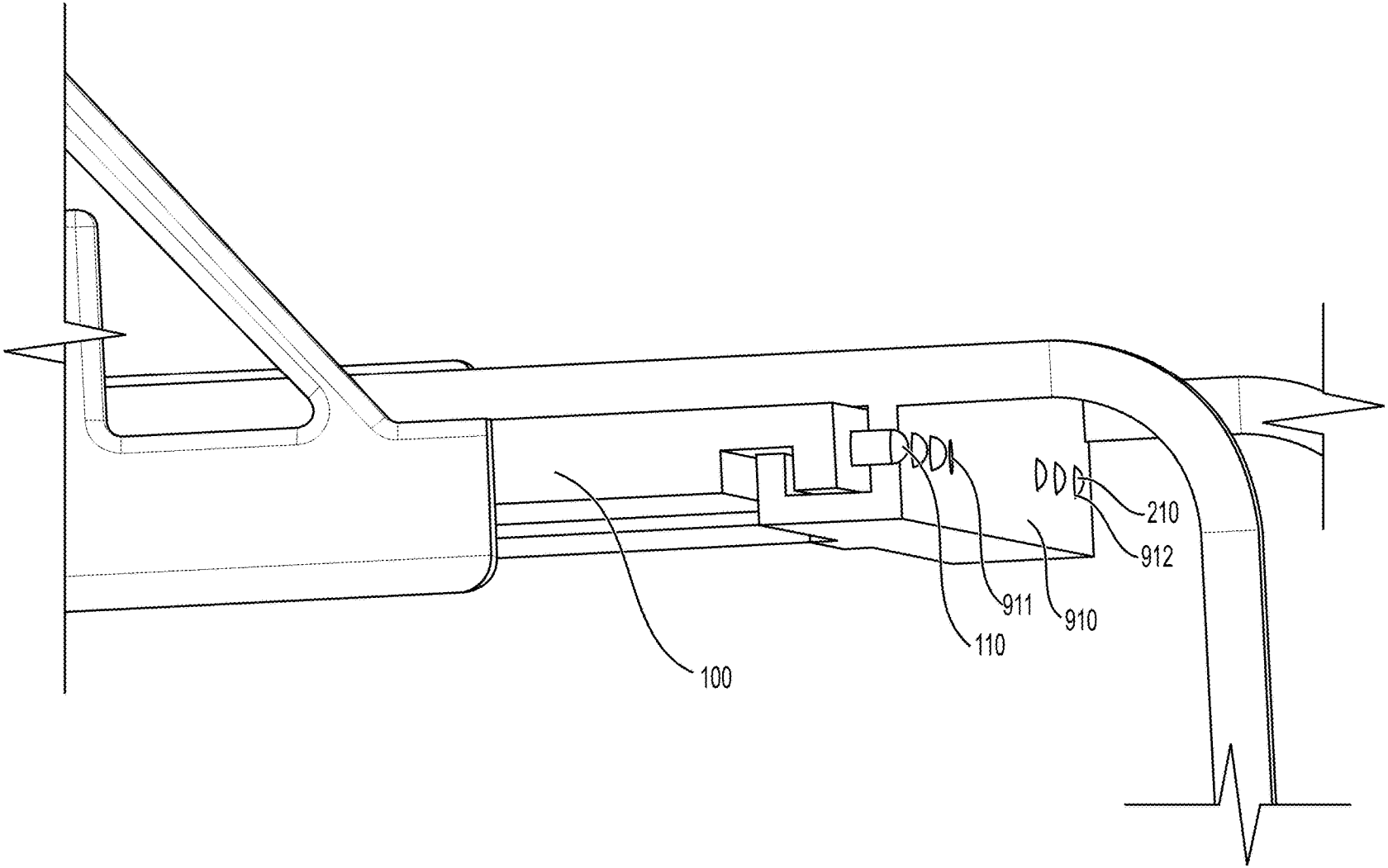
FIG. 13 is a perspective view illustrating a portion of the chair depicted in FIG. 1.
Figure 14:
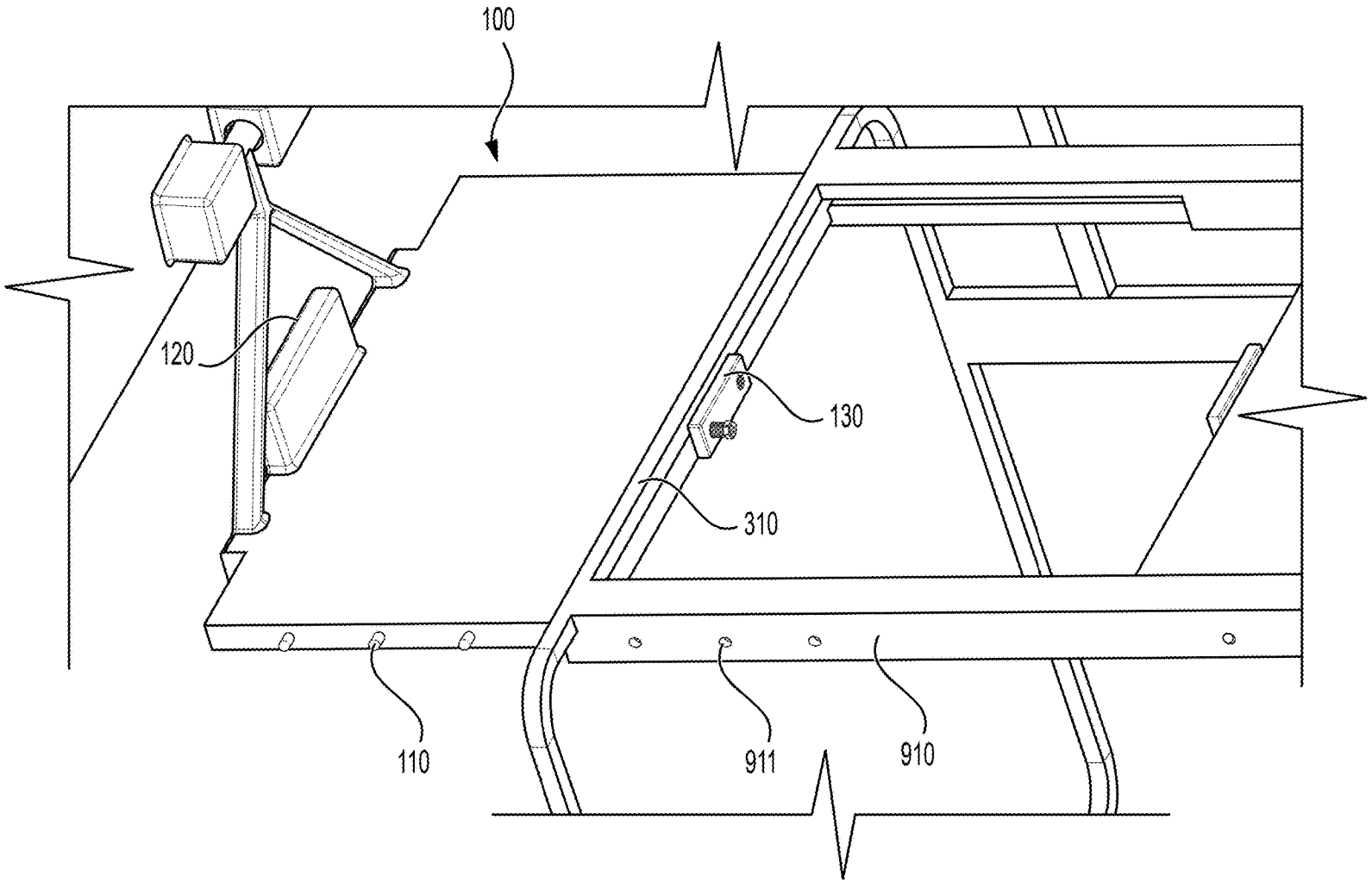
FIG. 14 is a perspective view illustrating a portion of the chair depicted in FIG. 1.

As illustrated in FIGS. 12-14, the first seat extension member 100 may include a first plurality of pins 110 spaced apart from one another in a width direction of the first seat extension member 100, the width direction of the first seat extension member 100 may be parallel to the width direction W1 of the seat 500. The first plurality of pins 110 may protrude from an exterior (e.g., front) side surface of the first extension member 100, as illustrated in FIGS. 12-14.

As illustrated in FIGS. 12-14, the first rail 910 may include a first plurality of through holes 911 spaced apart from one another along a length of the first rail 910. The first plurality of through holes 911 may be spaced apart from one another by about the same distance as a distance between adjacent pins 110 from the first plurality of pins 110, thereby enabling the first plurality of pins 110 to be inserted in the first plurality of through holes 911. The insertion of the first plurality of pins 110 in the first plurality of through holes 911 enables the first seat extension member 100 to be selectively fixed to the first and second rails 910, 920 at a desired location that ranges from between the retracted state of the first seat extension member 100 and the extended state of the first seat extension member, inclusive.

A second seat extension member 200 of the at least one seat extension member 100, 200 may be substantially a mirror opposite of the first seat extension member 100.

The second seat extension member 200 is configured to be selectively moved along the width direction W1 of the seat 500 between a retracted state thereof relative to the seat 500 and an extended state thereof relative to the seat 500. For example, the second seat extension member 200 can be moved (e.g., slid) along a portion of a length of the first and second rails 910, 920.

The second seat extension member 200 may overlap the seat 500 by a greater amount in the retracted state thereof than in the extended state thereof.

The second seat extension member 200 may be referred to as a left-hand side seat extension member since it can be pulled away from a left-hand side of the seat 500 (or extend to the left of the seat 500) to provide additional seating and/or storage area to the left-hand side of the seat 500.

The first and second rails 910, 920 connect the second seat extension member 200 to the seat 500 in a way that enables the second seat extension member 200 to be selective moved along the first and second rails 910, 920 and to support weight. The second seat extension member 200 may be moved along a different portion of the first and second rails 910, 920 than the portion of the first and second rails 910, 920 which the first seat extension member 100 may occupy. By way of non-limiting example, the second seat extension member 200 may be moved along a corresponding first half portion of the first and second rails 910, 920, while the first seat extension member 200 may be moved along a corresponding second half portion of the first and second rails 910, 920.

Referring to FIGS. 12-14, the second seat extension member 200 may include a second plurality of pins 210 spaced apart from one another in a width direction of the second seat extension member 200. The width direction of the second seat extension member 200 may be parallel to the width direction W1 of the seat 500. The second plurality of pins 210 may protrude from an exterior (e.g., front) side surface of the second extension member 200.

Referring to FIGS. 12-13, the first rail 910 may include a second plurality of through holes 912 spaced apart from one another along the length of the first rail. The second plurality of through holes 912 may be spaced apart from one another by approximately the same distance as a distance between adjacent pins 210 from the second plurality of pins 210, thereby enabling the second plurality of pins 210 to be inserted in the second plurality of through holes 912 such that the second seat extension member 200 can be selectively fixed at a desired location that ranges from between the retracted state of the second seat extension member 200 and the extended state of the second seat extension member 200, inclusive. FIG. 8 illustrates the second seat extension member 200 in the retracted state (e.g., retracted relative to the seat 500). FIGS. 1-2, 5 and 7 illustrate the second seat extension member 200 in the extended state.

Referring to FIG. 12, the chair may include a first frame member 310 (of the frame 300) disposed (or extending) between the seat 500 and the first seat extension member 100. The chair may also include a second frame member 320 (of the frame 300) disposed (or extending) between the seat 500 and the second seat extension member 200. The first and second frame member 310, 320 may be connected to the seat 500 to structurally connect the seat 500 with the plurality of legs 400 and the back support 600 via the frame 300.

Figure 5:
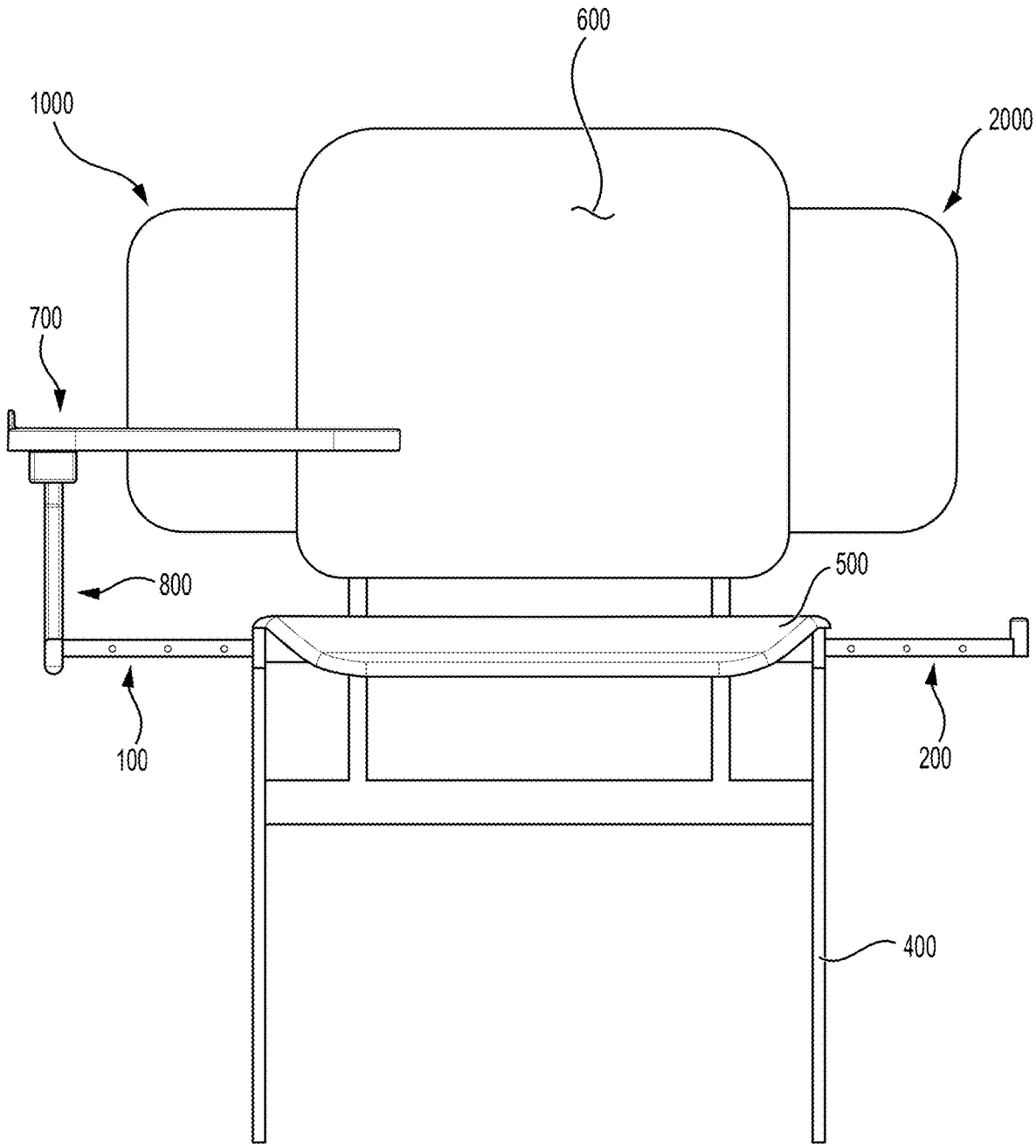
FIG. 5 is a first front side view illustrating the chair of FIG. 1.
Figure 6:
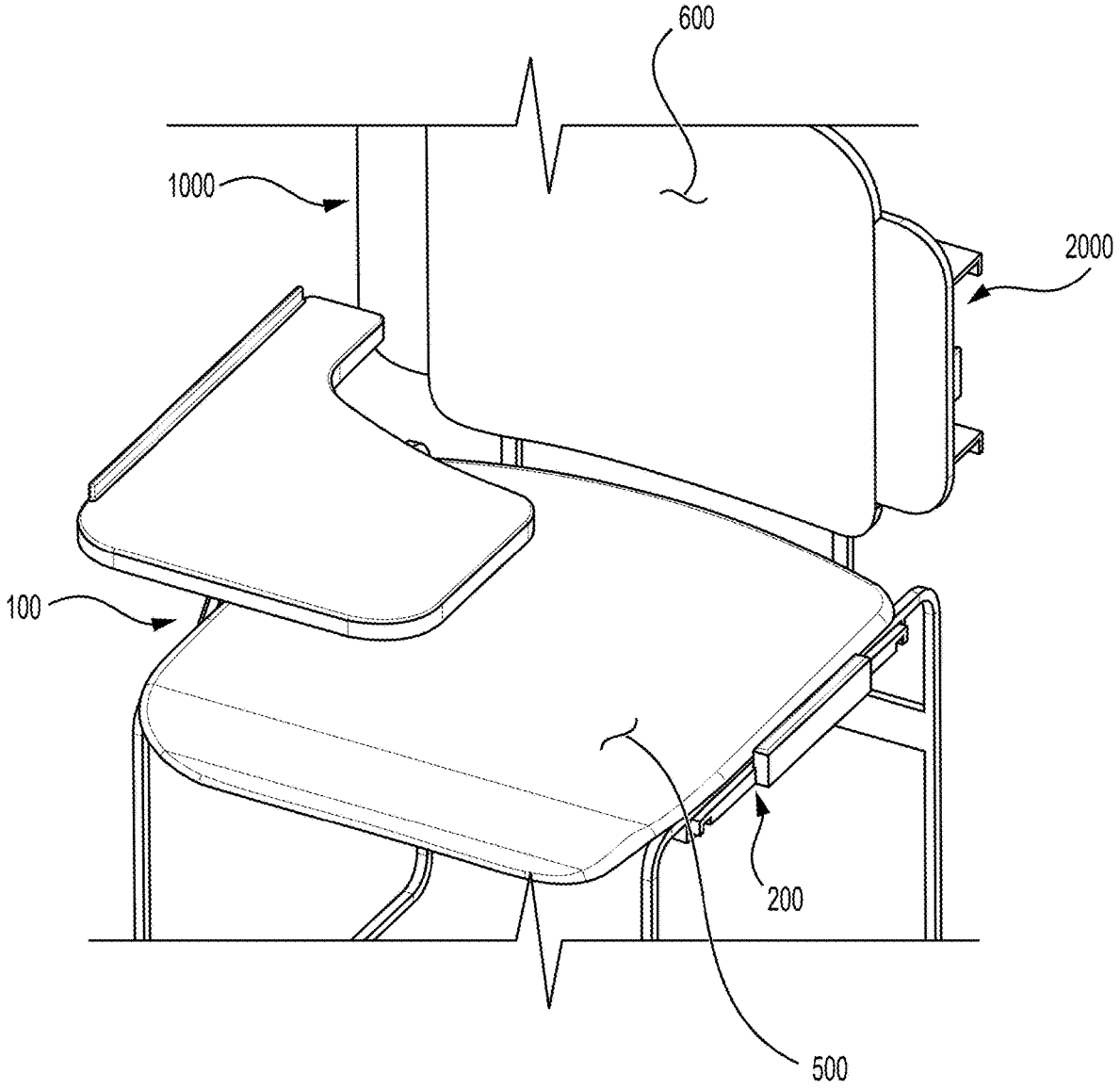
FIG. 6 is a perspective view illustrating a portion of the chair of FIG. 1.

Referring to FIGS. 12 and 14, the first seat extension member 100 may include an outer protrusion 120 and an inner protrusion 130. The inner protrusion 130 is configured to abut the first frame member 310 when the first seat extension member 100 is disposed at the extended state thereof (as shown in FIGS. 5 and 14), thereby preventing the first seat extension member 100 from being moved further away from the seat. In other words, the inner protrusion 130 can be used to prevent the first seat extension member from falling off the chair by limiting the distance by which the first seat extension member can be pulled away from the seat 500.

The outer protrusion 120 is configured to abut the first frame member 310 when the first seat extension member 100 is disposed at the retracted state thereof, thereby preventing the first seat extension member from being moved further toward the seat 500 once the outer protrusion 120 makes contact with the first frame member 310.

The second frame member 320 may be disposed opposite to the first frame member 310.

Figure 11:
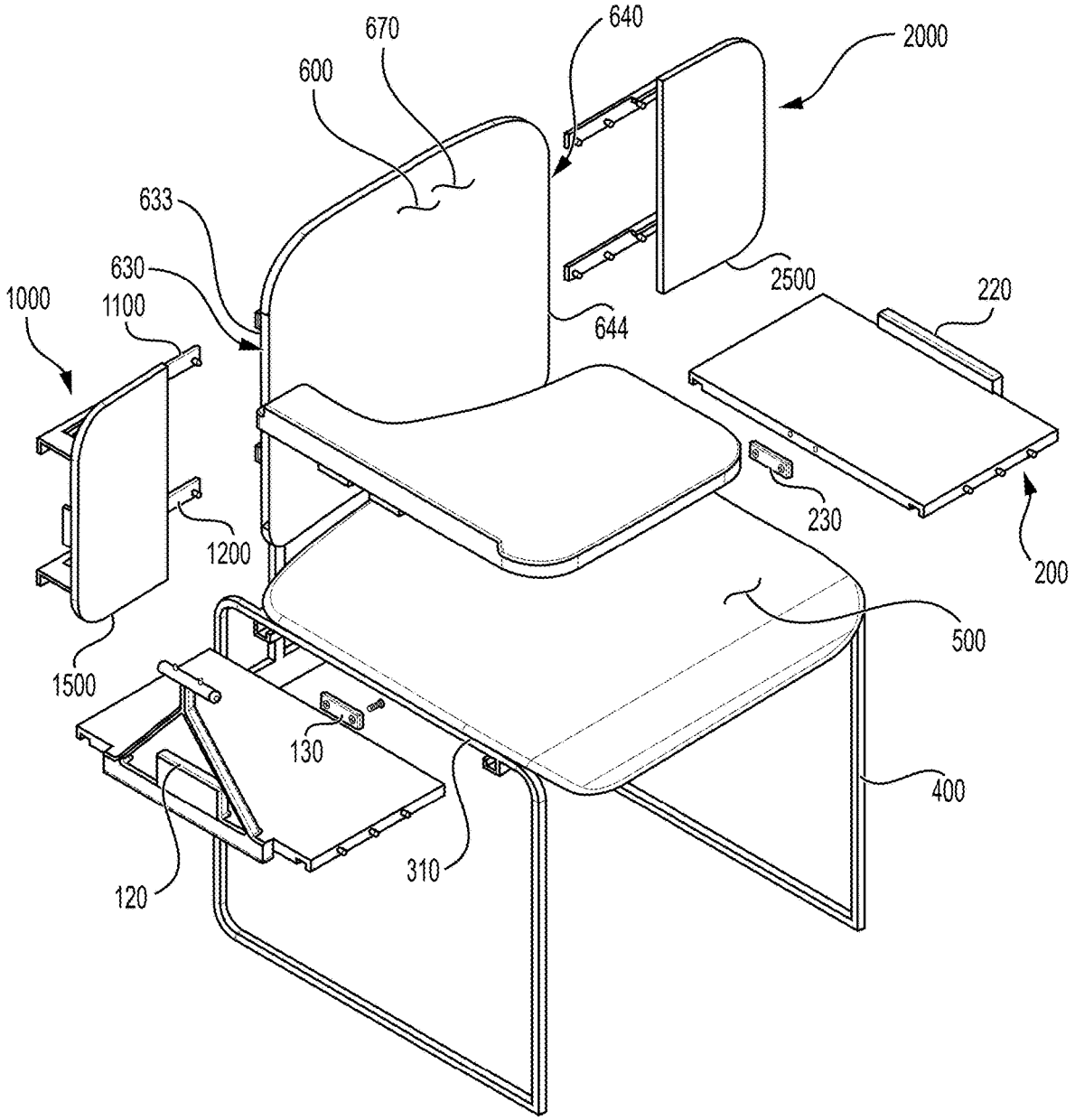
FIG. 11 is a first exploded perspective view illustrating the chair of FIG. 1.

Referring to FIGS. 11-12, the second seat extension member 200, may include an outer protrusion 220 and an inner protrusion 230. The inner and outer protrusions 230, 220 are configured to abut the second frame member 310 to limit the range of motion of the second seat extension member 200, similarly to the limitation of range of motion imparted by the inner and outer protrusions 130, 120 on the first seat extension member 100.

Figure 15:
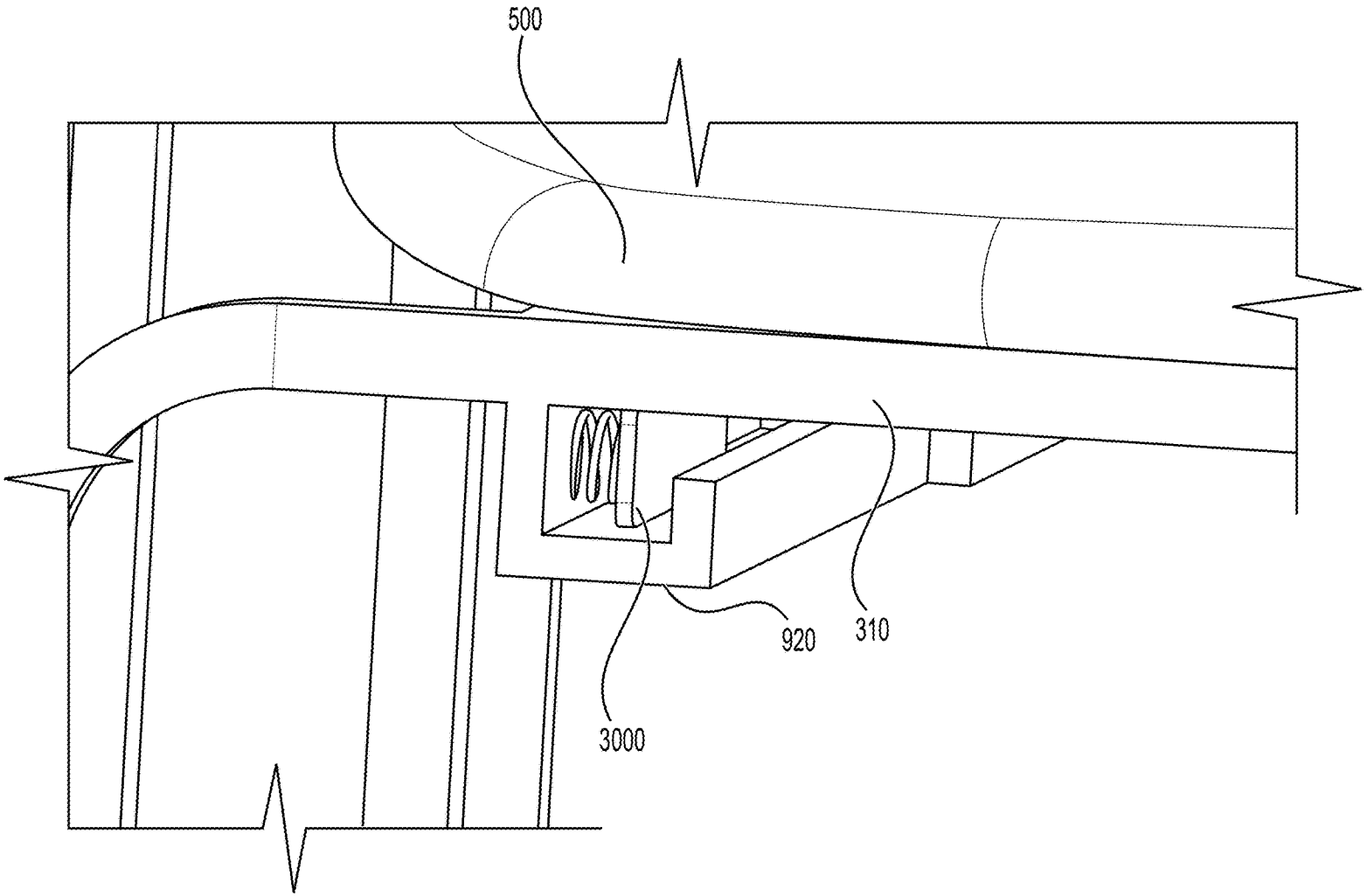
FIG. 15 is a perspective view illustrating a portion of the chair depicted in FIG. 1.
Figure 16:
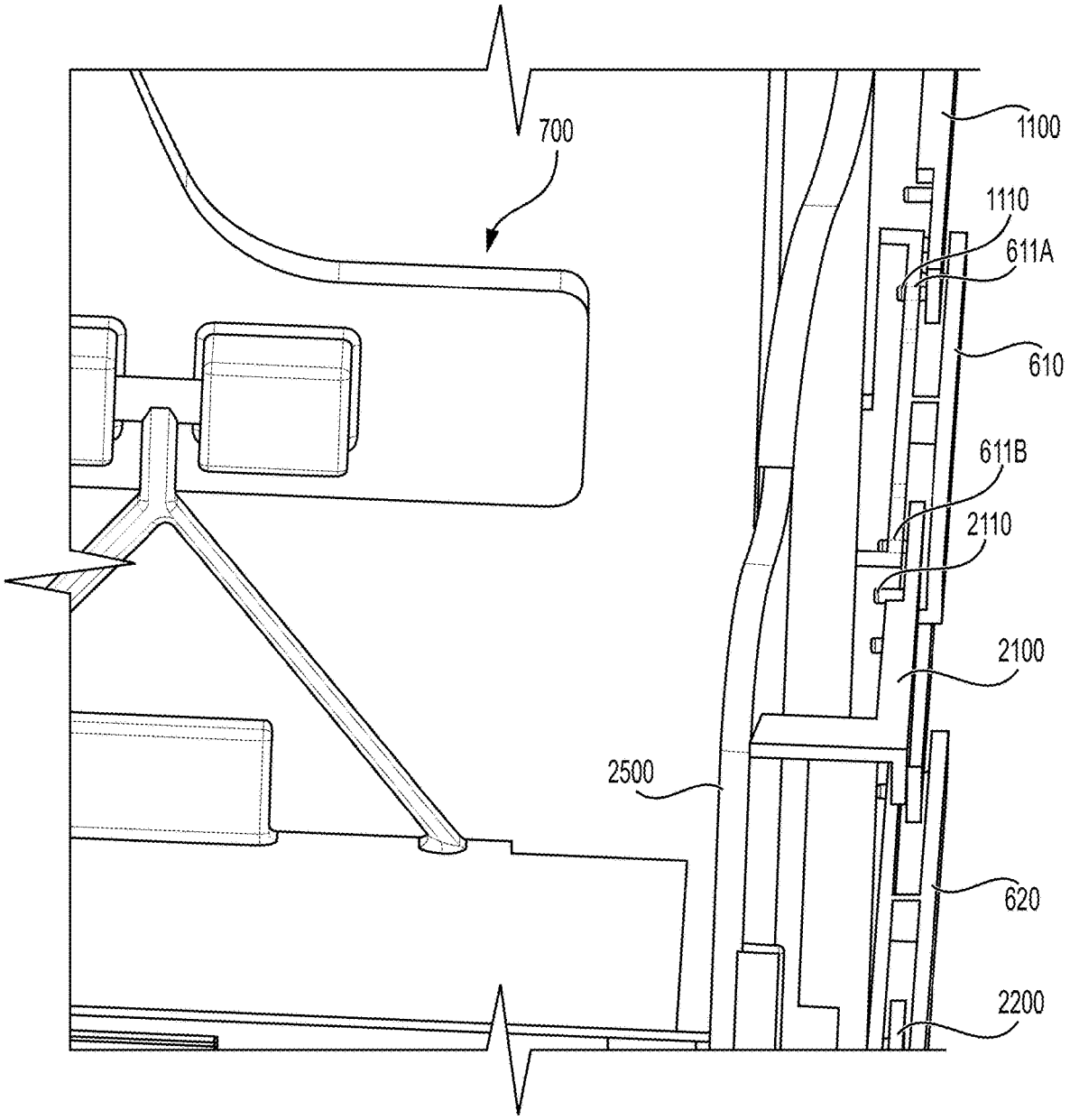
FIG. 16 is a perspective view illustrating a portion of the chair depicted in FIG. 1.
Figure 17:
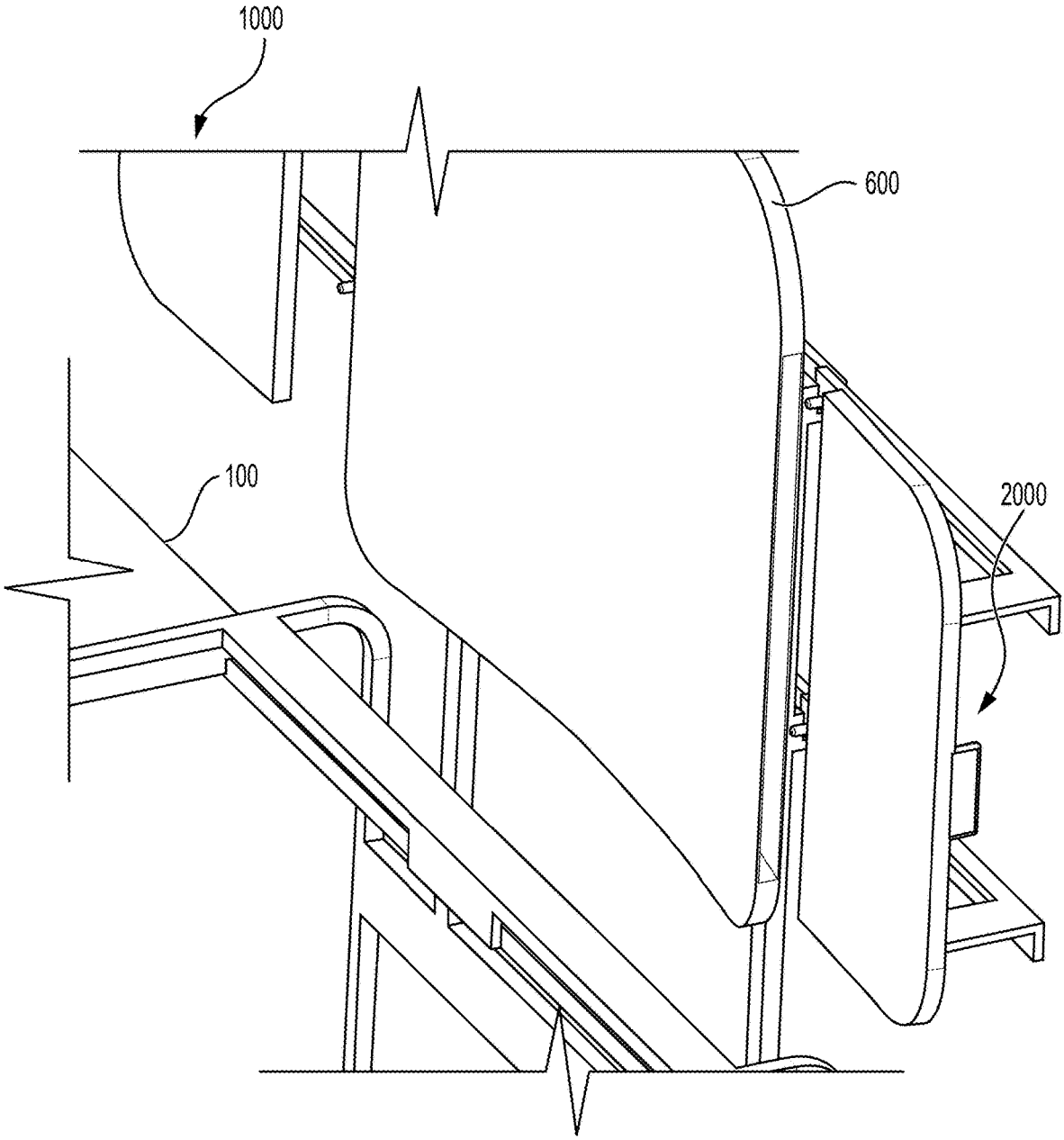
FIG. 17 is a perspective view illustrating a portion of the chair depicted in FIG. 1.

As can be gleaned with reference to FIGS. 12 and 15, the chair may include a first biasing member 3000 disposed between the second rail 920 and the first seat extension member 100. The first biasing member 3000 is configured to bias the first seat extension member 100 toward the first rail 910.

For example, the first biasing member 3000 can be a spring loaded member that directly contacts the second rail 920 and the first seat extension member 100, pushing the first seat extension member 100 toward the first rail 910 to ensure that the first seat extension member 100 does not become inadvertently retracted or extended in the width direction W1 by ensuring that the first plurality of pins 110 remain inserted in the first plurality of through holes 911.

To adjust the distance by which the first seat extension member 100 is extended (or retracted) relative to the seat 500, a user may press the first seat extension member 100 toward the second rail 920 by a level of force that is sufficient to overcome the biasing action of the first biasing member 3000, thereby disengaging the first plurality of pins 110 from the first plurality of through holes 911, and then move the first seat extension member 100 from the left to the right or from the right to the left along the width direction W1 of the seat 500, as desired.

The user may then stop pressing the first seat extension member 100 toward the second rail 920 such that the first biasing member 3000 can be used to lock the first seat extension member 100 in place by biasing the first plurality of pins 110 to be inserted in the first plurality of through holes 911 again.

Referring to FIG. 12, the chair may include a second biasing member 4000. The second biasing member 4000 can be disposed between the second rail 920 and the second seat extension member 200. The second biasing member 4000 is configured to bias the second seat extension member 200 toward the first rail 910. The second biasing member 4000 can be manipulated as indicated in this specification for the first biasing member 3000 to enable the second seat extension member 200 to be moved to a desired location between its retracted and extended states, and to be selectively locked at said desired location.

Referring to FIG. 11, a first cavity 630 of the back support 600 extends into the back support 600, from a first exterior side surface 633 of the back support 600, in the width direction of the back support (e.g., the first cavity 630 extends from the first exterior side surface 633 toward a second side surface 644 of the back support 600).

A first back support extension member 1000 of the at least one back support extension member 1000, 2000 can be movably received in the first cavity 630. The first back support extension member 1000 (e.g., a right-hand side back support extension member) can be selectively moved along the first cavity 630 to protrude from the first exterior side surface 633 of the back support 600 by a variable distance.

The chair may include first and second rails 610, 620 (see FIG. 7) connected to the back support 600 at a first side surface 660 (see FIG. 7) of the back support 600 that is opposite to a second side surface 670 (see FIG. 11) of the back support 600. The second side surface 670 is positioned to support a back of a person sitting on the chair. The first and second rails 610, 620 extend in the width direction of the back support 600. For example, the first and second rails 610, 620 extend in the width direction of the chair (e.g., between the left-hand side of the chair and the right-hand side of the chair) and may be spaced apart from one another along a height of the chair. The first and second rails 610, 620 may extend in parallel to one another The first back support extension member 1000 may include a first plate 1500 (see FIGS. 10 and 11) and first and second bars 1100, 1200 (see FIG. 7), the first and second bars 1100, 1200 being connected to the plate 1500 and movably (e.g., slidably) connected to the first and second rails 610 along their respective lengths.

For example, as illustrated in FIG. 12, the first and second rails 610, 620 may each form a groove (or channel) 615 extending in the length direction of the first and second rails 610, 620. The first bar 1100 may be inserted in the groove 615 of the first rail 610 and the second bar 1200 may be inserted in the groove 615 of the second rail 620.

Figure 18:
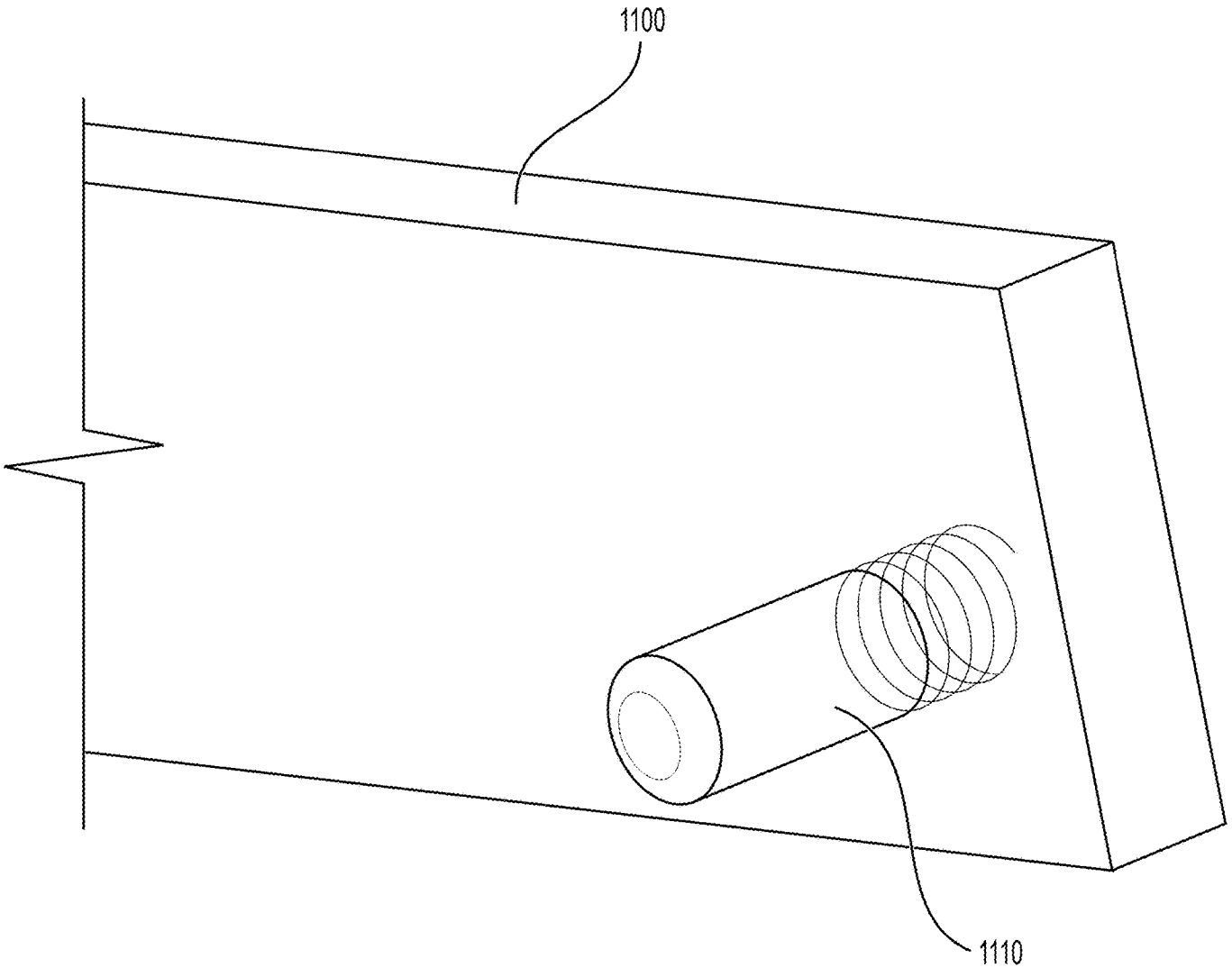
FIG. 18 is a perspective view illustrating a magnified region of a back support extension member of the chair depicted in FIG. 1.
Figure 19:
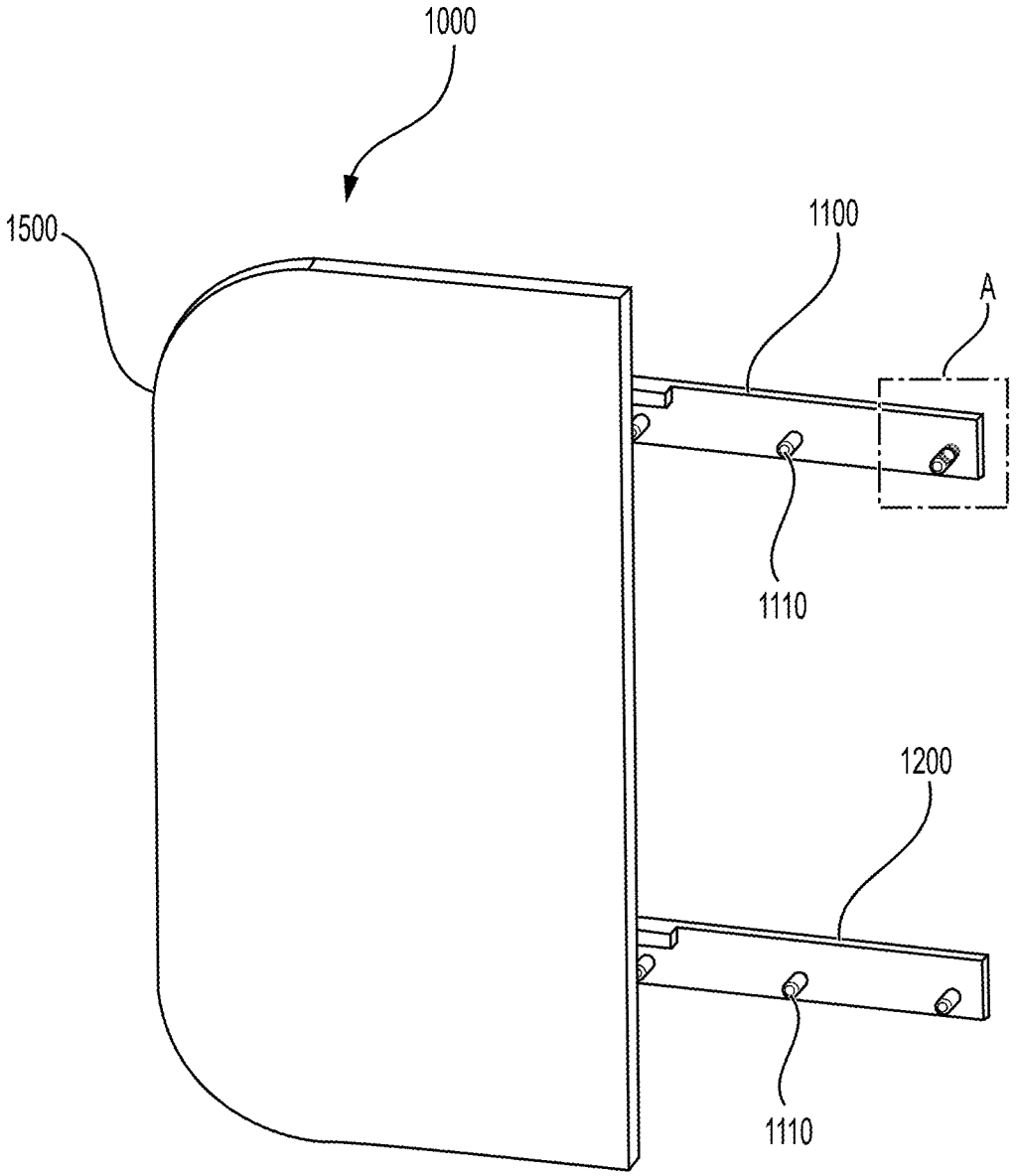
FIG. 19 is a perspective view illustrating a back support extension member of the chair depicted in FIG. 1 in isolation.

Referring to FIG. 18, which illustrated a magnified portion of the first bar 1100 (e.g., FIG. 18 illustrated a region A of FIG. 19), and referring to FIG. 19, at least one of the first and second bars 1100, 1200 includes a first plurality of biased pins 1110. At least one of the first and second rails 610, 620 includes a first plurality of through holes 611A (see FIG. 16) matching the first plurality of biased pins 1110. The first plurality of biased pins 1110 are configured to extend into the first plurality of matching holes 611A to selectively affix the first plate 1500 at a desired distance by which the first plate 1500 protrudes from the first cavity 630 to the right-hand side of the back support 600.

The first cavity 630 and the first back support member 1000 may be sized and shaped such that the first plate 1500 can fit entirely inside of the first cavity 630, thereby not protruding outwardly from the first exterior side surface 633 of the back support 630 or being substantially flush with the first exterior side surface 633 (e.g., fully retracted). The amount of distance by which the first plate 1500 protrudes from the first exterior surface 633 depends on the dimensions of the first plate 1500 and/or on positioning between the first and second bars 1100, 1200 and the first and second rails 610, 620.

The left-hand side of the back support 600 may be substantially a mirror opposite of the right-hand side of the back support 600, and a second back support extension member 2000 of the at least one back support extension member 1000, 2000 can be substantially a mirror opposite of the first back support extension member 1000.

Referring to FIG. 12, the back support 600 further includes a second cavity 640 extending into the back support 600, from a second exterior side surface 644 of the back support 600, in the width direction of the back support 600.

Referring to FIG. 11, the second back support extension member 2000 includes a second plate 2500 received in the second cavity 640. The second plate 2500 can be selectively moved along the second cavity 640 to protrude from the second exterior side surface 644 of the back support 600 by a variable distance.

Figure 10:
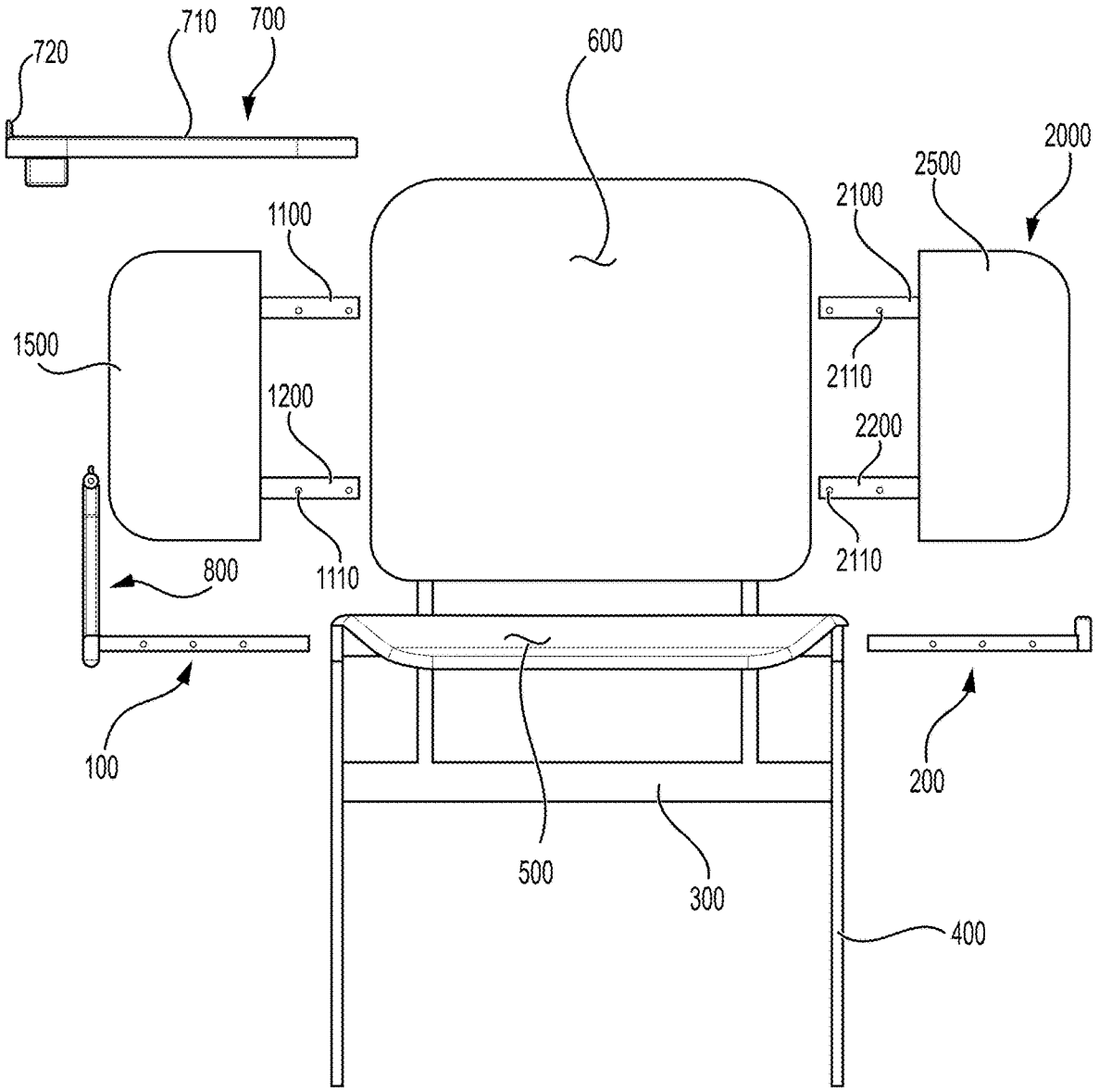
FIG. 10 is an exploded front view illustrating the chair of FIG. 1.

Referring to FIGS. 7 and 10, the second back support extension member 2000 further includes third and fourth bars 2100, 2200 connected to the second plate 2500, the third and fourth bars 2100, 2200 being movably connected to the first and second rails 610, 620 along their respective lengths. For example, the third and fourth bars 2100, 2200 can be connected to the first and second rails 610, 620 at a portion of the length of the first and second rails 610, 620 not occupied by the first and second bars 1100, 1200.

At least one of the third and fourth bars 2100, 2200 includes a second plurality of biased pins 2110 (see FIGS. 10 and 16), and at least one of the first and second rails 610, 1620 includes a second plurality of through holes 611B (see FIG. 16) matching the second plurality of biased pins 2210. The second plurality of biased pins 2110 are configured to extend into the second plurality of matching holes 611B to selectively affix the second plate 2500 at a desired distance by which the second plate 2500 protrudes from the second cavity 640.

As illustrated in FIG. 1, the first back support extension member 1000 may include a handle 1600 connected to the plate 1500 for grasping the first back support extension member 1000 and moving it along the first and second rails 610, 620. The handle 1600 can also be used to prevent the plate 1500 from being further inserted in the first cavity 630 when the handle 1600 comes in contact with the first exterior side surface 633 of the back support 600.

Figure 2:
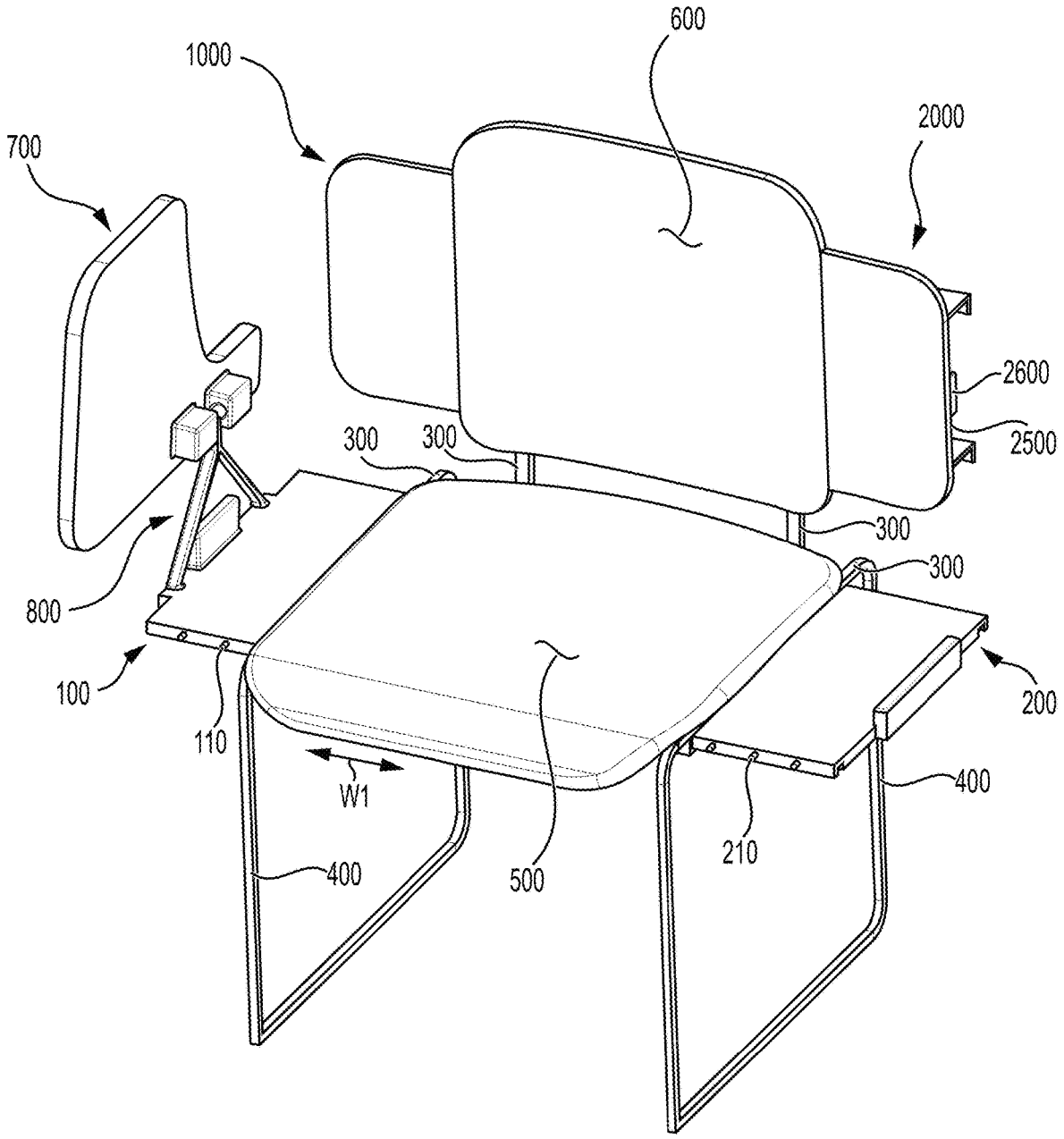
FIG. 2 is a second perspective view illustrating the chair of FIG. 1.
Figure 3:
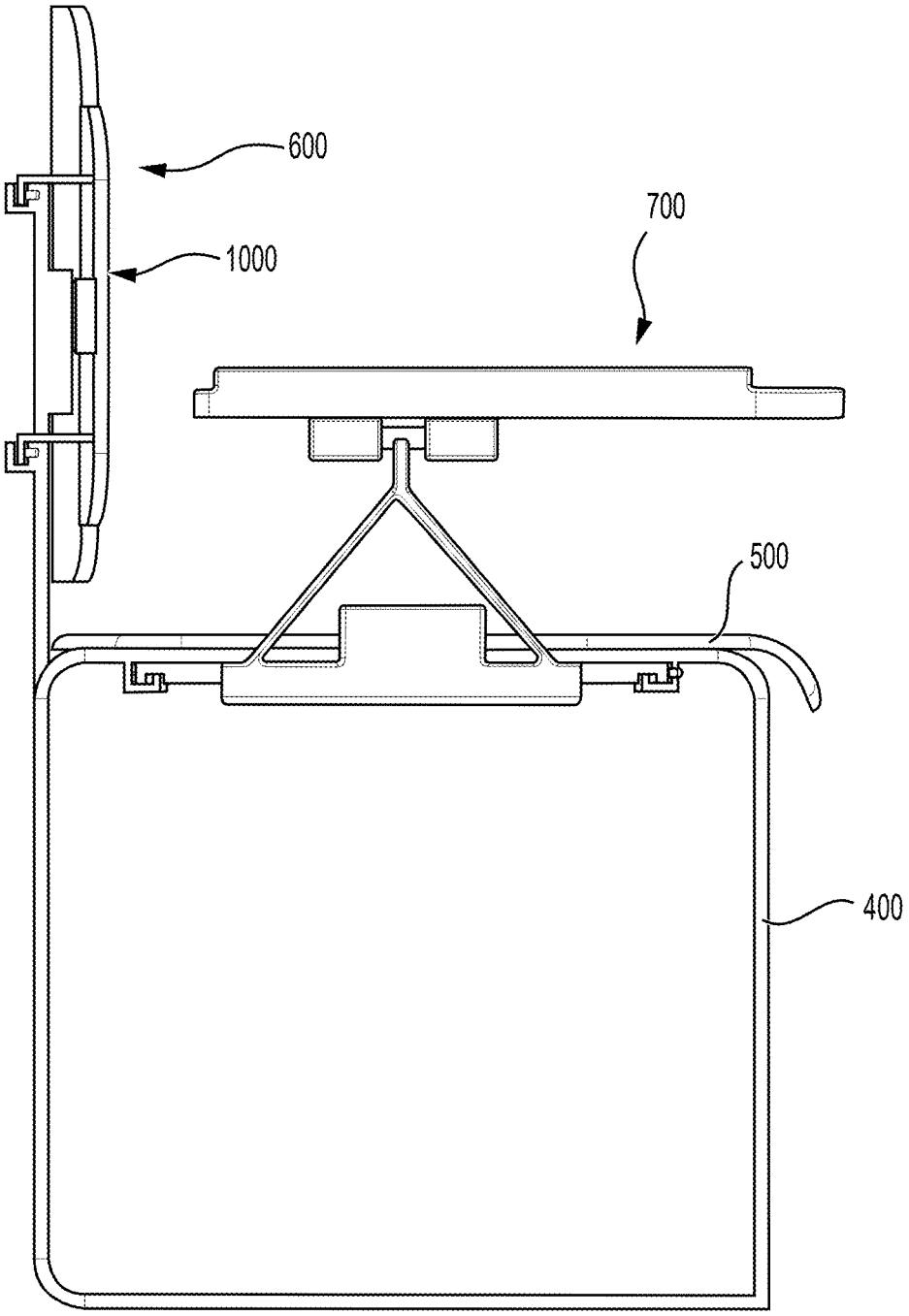
FIG. 3 is a right side view illustrating the chair of FIG. 1.
Figure 4:
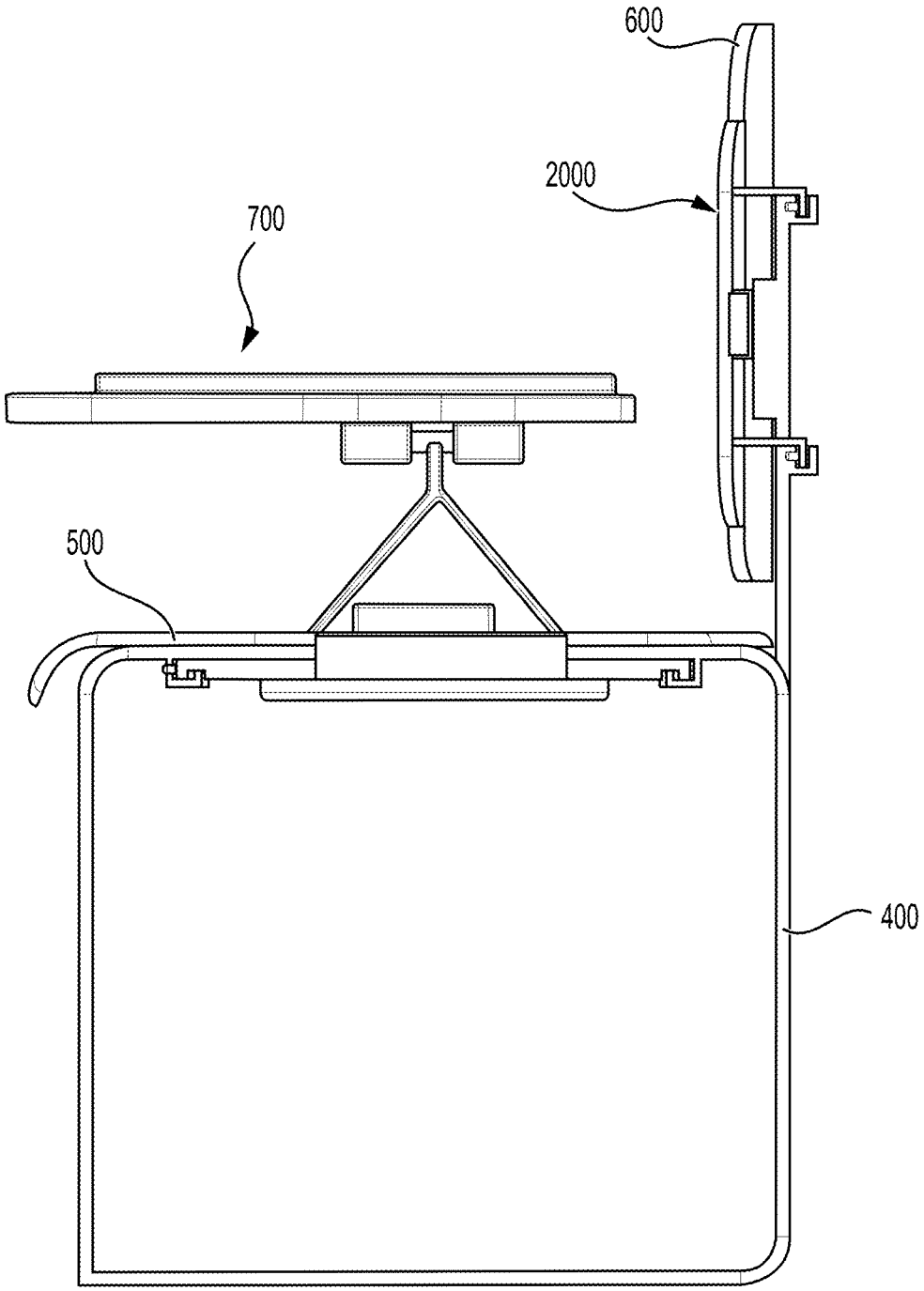
FIG. 4 is a left side view illustrating the chair of FIG. 1.

Referring to FIG. 2, the second back support extension member 2000 may include a handle 2600 connected to the plate 2500 for grasping the second back support extension member 2000 and moving it along the first and second rails 610, 620. The handle 2600 can also be used to prevent the plate 2500 from being inserted further into the second cavity 640 when the handle 2600 comes in contact with the second exterior side surface 644 of the back support 600.

The back support 600 may be fixedly connected to the seat 500 via the frame 300.

The connector 800 may connect the first seat extension member with the arm support 700. The arm support 700 may be pivotally connected to the connector 800 such that the arm support 700 can be selectively pivoted between an open (or open access) state, as illustrated in FIG. 2, enabling a user to more comfortably seat in the chair, and a closed state, as illustrated in FIG. 1, where the arm support 700 is positioned in a state where it can be used to support the arm of a user such that the user can write on the arm support 700 and to support weight (e.g., to hold books, objects, etc.) thereon.

Referring to FIGS. 1 and 10, the arm support 700 includes a plate-like supporting member 710 that can be used as a writing surface, and a raised edge (or protrusion) 720. As illustrated in FIG. 1, the raised edge 720 may extend on a right-hand side (e.g., an outer peripheral side) of the supporting member 710 to prevent objects such as a pen, a pencil, etc., from rolling off the far side (or right-hand side) of the arm support 700.

The chair illustrated in FIGS. 1-19 is configured to be used by a person who writes with the right hand. However, a chair as described in this specification can also be configured to suit the needs of a person who writes with the left hand. In the case of left-hand writers, the connector 800 can be connected to the second seat extension member 200 and an arm support that is configured to be a mirror opposite of the arm support 700, potentially including e.g., a plate-like supporting member and a raised edge, can be pivotally connected to the connector 800 at the second seat extension member 200.

The connector 800 of the chair described with reference to FIGS. 1-19 has a fixed length, thereby resulting in the arm support 700 having a fixed height. However, the present subject matter is not limited to a chair having an arm support with a fixed length. A connector of a chair of the present subject matter can also be configured to have an adjustable length, providing a user with the option to selectively adjust the height of the arm support as needed.

Figure 20:
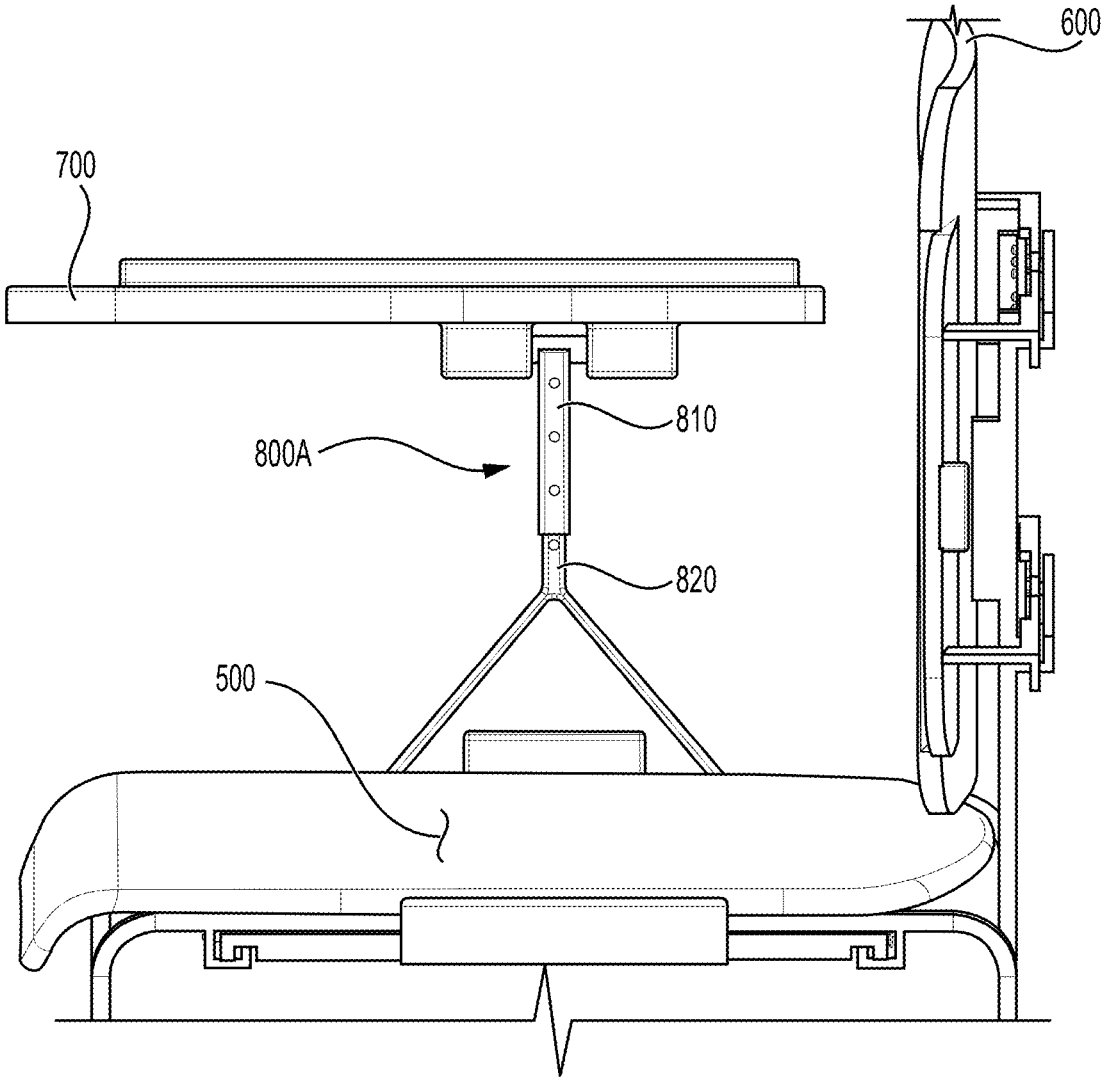
FIG. 20 is a perspective view illustrating a chair with a connector in accordance with an embodiment of the present disclosure.
Figure 21:
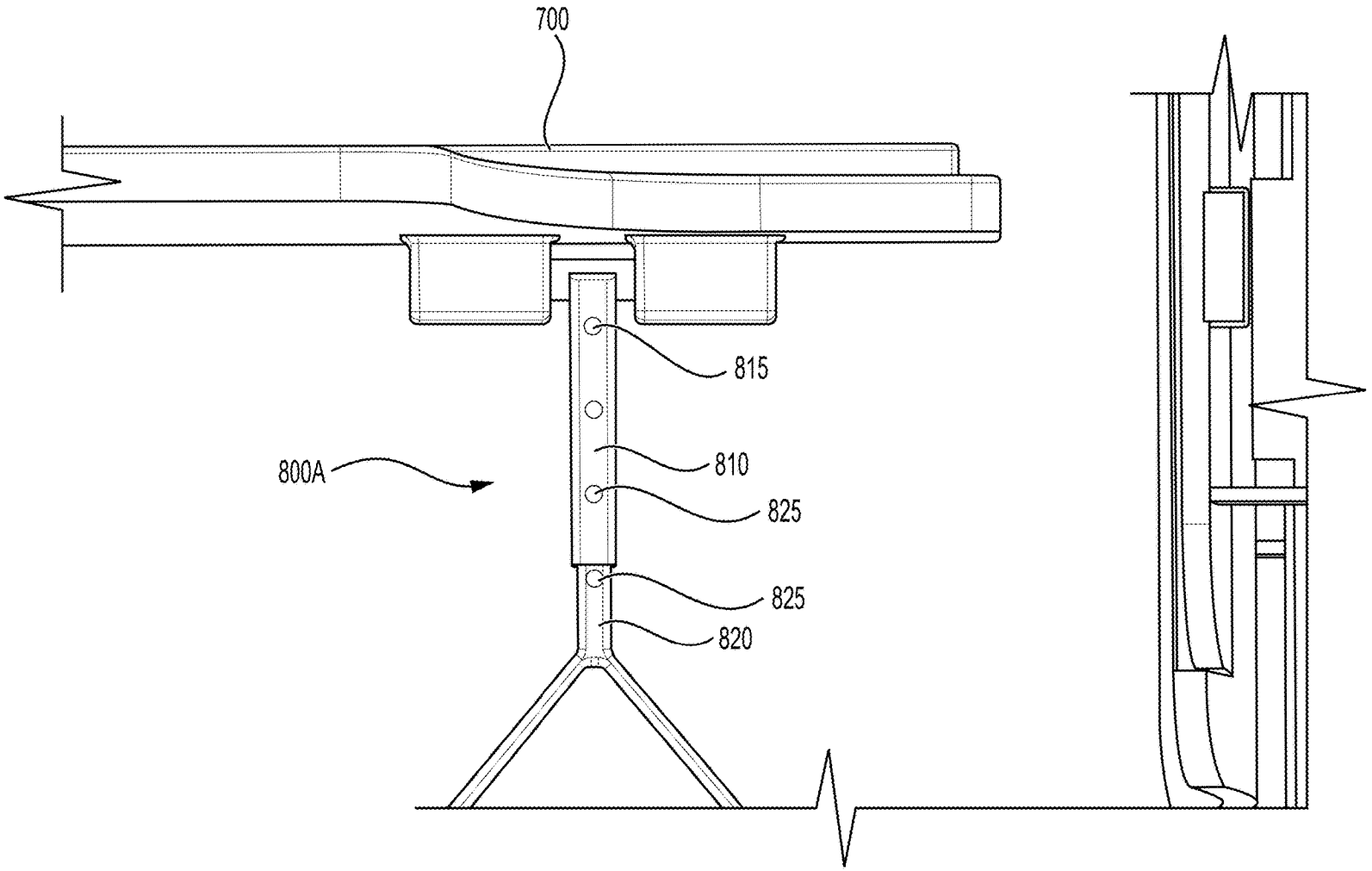
FIG. 21 is a magnified perspective view illustrating a portion of the chair of FIG. 20.
Figure 22:
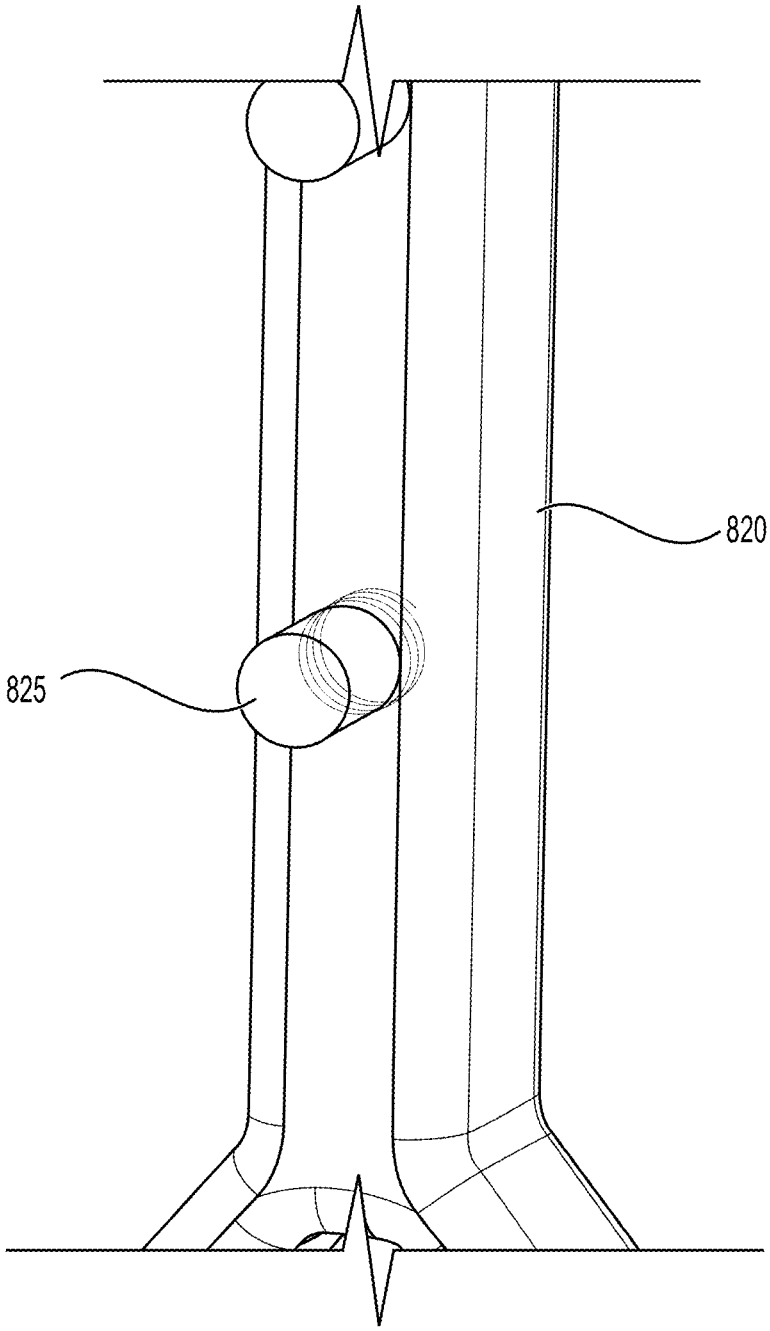
FIG. 22 is a perspective view illustrating a portion of the connector of the chair of FIG. 20 in isolation.

FIGS. 20-22 illustrate a chair having a connector 800A with an adjustable length. As illustrated in FIGS. 20-22, the connector 800 includes a first elongated member 810 and a second elongated member 820. The first and second elongated members 810, 820 are movably connected to one another along their respective lengths.

The first elongated member 810 has a cavity extending in a length direction thereof. The first elongated member 810 may include a plurality of through openings 815 along its length, the through openings 815 connecting the cavity with an exterior of the first elongated member 810.

The second elongated member 820 can be inserted lengthwise in the cavity of the first elongated member 810. The second elongated member 820 may include a plurality of biased pins 825 matching a spacing of the through openings 815 of the first elongated member 810 such that a height of the arm support 700A can be selectively adjusted by inserting at least one of the plurality of biased pins 825 of the second elongated member 820 in a desired through opening 815 from among the plurality of through openings 815 of the first elongated member 810.

All other aspects or components of the chair of FIGS. 20-22 not explicitly described in this specification may be the same as or similar to respective components described with reference to the chair of FIGS. 1-19.

A method of using a chair of the present subject matter includes obtaining a chair as described in this specification. The method includes performing at least one action from the group consisting of a) moving the at least one seat extension member 100, 200 away from the seat 500 to widen an area of the chair that can be using for sitting, and b) moving the at least one back support extension member 1000, 2000 away from the back support 600 to widen an area of the chair that can be using for supporting a user's back.

The method may include pivoting the arm support 700 away from the seat to facilitate access to the seat 500.

The method may also include increasing the adjustable length of the connector 800A to raise the arm support 700 and reducing the adjustable length of the connector 800A to lower the arm support 700.

While the present disclosure has been particularly shown and described with reference to exemplary embodiments thereof, it will be apparent to those of ordinary skill in the art that various changes in form and detail may be made therein without departing from the spirit and scope of the present disclosure as defined by the following claims.

What is claimed is:

1. A chair comprising:

a plurality of legs;

a seat connected to the plurality of legs;

at least one seat extension member movably connected to the seat such that the at least one seat extension member can be selectively moved along a width direction of the seat by a variable distance;

a back support connected to the seat via a frame, the back support having at least one cavity extending into the back support, from at least one exterior side surface of the back support, in a width direction of the back support, the back support and the seat extending between a left-hand side of the chair and a right-hand side of the chair along their respective widths;

at least one back support extension member received in the at least one cavity, wherein the at least one back support extension member can be selectively moved along the at least one cavity to protrude from the at least one exterior side surface of the back support by a variable distance;

an arm support; and a connector extending between a first seat extension member from among the at least one seat extension member and the arm support, the connector connecting the first seat extension with the arm support, wherein the back support includes a first cavity extending into the back support, from a first exterior side surface of the back support, in the width direction of the back support, wherein a first back support extension member of the at least one back support extension member includes a first plate received in the first cavity, wherein the first plate can be selectively moved along the first cavity to protrude from the first exterior side surface of the back support by a variable distance, wherein the chair further comprises first and second rails connected to the back support at a first side surface of the back support that is opposite to a second side surface of the back support, the second side surface of the back being positioned to support a back of a person sitting on the chair, the first and second rails extending in the width direction of the back support, and wherein the first back support extension member further includes first and second bars connected to the first plate, the first and second bars being movably connected to the first and second rails along their respective lengths.

2. The chair of claim 1, wherein a first seat extension member of the at least one seat extension member is configured to be selectively moved along the width direction of the seat between a retracted state and an extended state relative to the seat, the first seat extension overlapping the seat by a greater amount in the retracted state than in the extended state.

3. The chair of claim 2, further comprising a first rail and a second rail spaced apart from the first rail, the first and second rails extending lengthwise in the width direction of the seat, the first and second rails connecting the first seat extension member to the seat in a way that enables the first seat extension member to be selective moved along the first and second rails and to support weight.

4. The chair of claim 3, wherein a second seat extension member of the at least one seat extension member is configured to be selectively moved along the width direction of the seat between a retracted state and an extended state relative to the seat, the second seat extension overlapping the seat by a greater amount in the retracted state thereof than in the extended state thereof, wherein the first and second rails connect the second seat extension member to the seat in a way that enables the second seat extension member to be selective moved along the first and second rails and to support weight.

5. The chair of claim 4, wherein the second seat extension member includes a second plurality of pins spaced apart from one another in a width direction of the second seat extension member, the second plurality of pins protruding from an exterior side surface of the second extension member, and wherein the first rail includes a second plurality of through holes spaced apart from one another along a length of the first rail, the second plurality of through holes being spaced apart from one another by approximately the same distance as a distance between adjacent pins from the second plurality of pins, thereby enabling the second plurality of pins to be inserted in the second plurality of through holes such that the second seat extension member can be selectively fixed at a location between the retracted state thereof and the extended state thereof.

6. The chair of claim 2, the frame comprising a first frame member disposed between the seat and the first seat extension member, wherein the first seat extension member further includes an outer protrusion and an inner protrusion, the inner protrusion being configured to abut the first frame member when the first seat extension member is disposed at the extended state thereof, thereby preventing the first seat extension member from being moved further away from the seat, and the outer protrusion being configured to about the first frame member when the first seat extension member is disposed at the retracted state thereof, thereby preventing the first seat extension member from being moved further toward the seat.

7. The chair of claim 6, the frame further comprising a second frame member disposed between the seat and a second seat extension member of the at least one seat extension member, wherein the second seat extension member is configured to be selectively moved along the width direction of the seat between a retracted state thereof and an extended state thereof relative to the seat, the second seat extension overlapping the seat by a greater amount in the retracted state thereof than in the extended state thereof, wherein the second seat extension member further includes an outer protrusion thereof and an inner protrusion thereof, the inner protrusion of the second seat extension member being configured to abut the second frame member when the second seat extension member is disposed at the extended state thereof, thereby preventing the second seat extension member from being moved further away from the seat, and the outer protrusion of the second seat extension member being configured to about the second frame member when the second seat extension member is disposed at the retracted state thereof, thereby preventing the second seat extension member from being moved further toward the seat.

8. The chair of claim 1, wherein at least one of the first and second bars includes a first plurality of biased pins, and at least one of the first and second rails includes a first plurality of through holes matching the first plurality of biased pins, the first plurality of biased pins being configured to extend into the first plurality of matching holes to selectively affix the first plate at a desired distance by which the first plate protrudes from the first cavity.

9. The chair of claim 1, wherein the back support further includes a second cavity extending into the back support, from a second exterior side surface of the back support, in the width direction of the back support, wherein a second back support extension member of the at least one back support extension member includes a second plate received in the second cavity, wherein the second plate can be selectively moved along the second cavity to protrude from the second exterior side surface of the back support by a variable distance, wherein the second back support extension member further includes third and fourth bars connected to the second plate, the third and fourth bars being movably connected to the first and second rails along their respective lengths.

10. The chair of claim 9, wherein at least one of the third and fourth bars includes a second plurality of biased pins, and at least one of the first and second rails includes a second plurality of through holes matching the second plurality of biased pins, the second plurality of biased pins being configured to extend into the second plurality of matching holes to selectively affix the second plate at a desired distance by which the second plate protrudes from the second cavity.

11. The chair of claim 1, wherein the arm support is pivotally coupled to the connector of the chair.

12. The chair of claim 11, wherein the arm support includes a plate-like supporting member and a raised edge extending along an outer peripheral side of the plate-like supporting member.

13. The chair of claim 1, wherein the connector support has a fixed length.

14. The chair of claim 1, wherein the connector includes a first elongated member and a second elongated member, wherein the first and second elongated members are movably connected to one another along their respective lengths such that a length of the connector can be selectively adjusted.

15. The chair of claim 14, wherein the first elongated member has a cavity extending in a length direction thereof, the first elongated member having a plurality of through openings along its length, the through openings connecting the cavity with an exterior of the first elongated member, and wherein the second elongated member is inserted lengthwise in the cavity of the first elongated member, the second elongated member including a plurality of biased pins matching a spacing of the through openings of the first elongated member such that a height of the arm support can be selectively adjusted by inserting at least one of the plurality of biased pins of the second elongated member in a desired through opening from among the plurality of through openings of the first elongated member.

16. A method of using a chair, comprising:

obtaining a chair, the chair including:

a plurality of legs;

a seat connected to the plurality of legs;

at least one seat extension member movably connected to the seat such that the at least one seat extension member can be selectively moved along a width direction of the seat by a variable distance;

a back support connected to the seat via a frame, the back support having at least one cavity extending into the back support, from at least one exterior side surface of the back support, in a width direction of the back support, the back support and the seat extending between a left-hand side of the chair and a right-hand side of the chair along their respective widths;

at least one back support extension member received in the at least one cavity, wherein the at least one back support extension member can be selectively moved along the at least one cavity to protrude from the at least one exterior side surface of the back support by a variable distance;

an arm support; and a connector extending between a first seat extension member from among the at least one seat extension member and the arm support, the connector connecting the first seat extension with the arm support; and performing at least one action from the group consisting of a) moving the at least one seat extension member away from the seat to widen an area of the chair that can be using for sitting, and b) moving the at least one back support extension member away from the back support to widen an area of the chair that can be using for supporting a user's back, wherein the connector has an adjustable length, the method further comprising increasing the adjustable length of the connector to raise the arm support.

17. The method of claim 16, wherein the arm support is pivotally connected to the connector, the method further comprising: pivoting the arm support away from the seat to facilitate access to the seat.

18. A chair comprising:

a plurality of legs;

a seat connected to the plurality of legs;

at least one seat extension member movably connected to the seat such that the at least one seat extension member can be selectively moved along a width direction of the seat by a variable distance;

a back support connected to the seat via a frame, the back support having at least one cavity extending into the back support, from at least one exterior side surface of the back support, in a width direction of the back support, the back support and the seat extending between a left-hand side of the chair and a right-hand side of the chair along their respective widths;

at least one back support extension member received in the at least one cavity, wherein the at least one back support extension member can be selectively moved along the at least one cavity to protrude from the at least one exterior side surface of the back support by a variable distance;

an arm support; and a connector extending between a first seat extension member from among the at least one seat extension member and the arm support, the connector connecting the first seat extension with the arm support, wherein a first seat extension member of the at least one seat extension member is configured to be selectively moved along the width direction of the seat between a retracted state and an extended state relative to the seat, the first seat extension overlapping the seat by a greater amount in the retracted state than in the extended state, the chair further comprising a first rail and a second rail spaced apart from the first rail, the first and second rails extending lengthwise in the width direction of the seat, the first and second rails connecting the first seat extension member to the seat in a way that enables the first seat extension member to be selective moved along the first and second rails and to support weight, wherein the first seat extension member includes:

a first plurality of pins spaced apart from one another in a width direction of the first seat extension member, the first plurality of pins protruding from an exterior side surface of the first extension member, and a first biasing member disposed between the second rail and the first seat extension member, the first biasing member being configured to bias the first seat extension member toward the first rail, wherein the first rail includes a first plurality of through holes spaced apart from one another along a length of the first rail, the first plurality of through holes being spaced apart from one another by approximately the same distance as a distance between adjacent pins from the first plurality of pins, thereby enabling the first plurality of pins to be inserted in the first plurality of through holes such that the first seat extension member can be selectively fixed at a location between the retracted state thereof and the extended state thereof.

* * * * *